US008349131B1

(12) United States Patent
Agarwal et al.

(10) Patent No.: US 8,349,131 B1
(45) **Date of Patent: *Jan. 8, 2013**

(54) METHOD FOR THE MANUFACTURE OF SMART PAPER AND SMART WOOD MICROFIBERS

(75) Inventors: Mangilal Agarwal, Ruston, LA (US); Yuri M. Lvov, Ruston, LA (US); Khodadad Varahramyan, Ruston, LA (US)

(73) Assignee: Louisiana Tech Research Foundation: a division of Louisiana Tech University Foundation, Inc., Ruston, LA (US)

( * ) Notice: Subject to any disclaimer, the term of this patent is extended or adjusted under 35 U.S.C. 154(b) by 1104 days.

This patent is subject to a terminal disclaimer.

(21) Appl. No.: 11/928,626

(22) Filed: Oct. 30, 2007

Related U.S. Application Data

(60) Provisional application No. 60/863,712, filed on Oct. 31, 2006.

(51) Int. Cl.
*D21F 11/00* (2006.01)

(52) U.S. Cl. ..... 162/138

(58) Field of Classification Search ..... 162/138
See application file for complete search history.

(56) References Cited

U.S. PATENT DOCUMENTS

| | | | | |
|---|---|---|---|---|
| 6,440,272 | B1 * | 8/2002 | Binder et al. | 162/261 |
| 6,455,661 | B1 | 9/2002 | Antal et al. | |
| 6,616,806 | B2 | 9/2003 | I Chen | |
| 7,258,764 | B2 * | 8/2007 | Mauler | 162/158 |
| 7,842,162 | B1 * | 11/2010 | Lvov et al. | 162/158 |
| 7,943,066 | B2 | 5/2011 | Ni et al. | |
| 2007/0153363 | A1 * | 7/2007 | Gruner | 359/315 |

OTHER PUBLICATIONS

Agarwal et al, Conductive wood microfibers for smart paper through layer-by-layer nanocoating, Oct. 6, 2006, Nanotechnology 17 (2006) 5319-5325.*

Eriksson et al, The influence on paper strength properties when building multilayers of weak polyelectrolytes onto wood fibers, Jul. 1 2005, Journal of Colloid and Interface Science 292 pp. 38-45.*

Patel, Layer-by-layer self assembly for enzyme and DNA encapsulation and delivery. Louisiana Tech University, 2004.*

"A Review on Use of Fillers in Cellulosic Paper for Functional Applications"; Jing Shen, Zhanquan Song, Xueren Qian and Yonghao Ni; Ind. Eng. Chem. Res. 2011, 50,661-666.

"Nanocoating of natural cellulose fibers with conjugated polymer: hierarchical polypyrrole composite materials"; Jianguo Huang, Lzumi Lchinose, and Toyoki Kunitakeb; Chem. Commun., 2005,1717-1719.

* cited by examiner

*Primary Examiner* — Matthew Daniels
*Assistant Examiner* — Jacob Thomas Minskey
(74) *Attorney, Agent, or Firm* — Jones Walker Waechter Poitevent Carrere & Denegre, LLP

(57) ABSTRACT

A method is provided for making "smart" paper and "smart" microfibers by means of nanotechnology layer-by-layer techniques. The method comprises forming an aqueous pulp of lignocellulose fibers and nanocoating it by alternatively adsorbing onto the fibers multiple consecutively-applied layers of organized ultra thin and oppositely-charged polyelectrolytes, at least one of which is an electrically conductive polymer or nanoparticle (or a magnetically active polymer or nanoparticle, or an optically active polymer or nanoparticle), and another one of which has a charge opposite of said electrically conductive polymer or nanoparticle (or magnetically active polymer or nanoparticle, or optically active polymer or nanoparticle), thereby making a modified aqueous pulp of electrically conductive (or magnetically active, or optically active) multi-layer nanocoated lignocellulose fibers; then draining the water out of the modified aqueous pulp to form sheets of smart microfibers. A finished paper is manufactured by drying the sheets of the nanocoated multi-layer fibers and processing the dried sheets to make a smart paper having enhanced electrical conductivity, magnetic and/or optical properties.

9 Claims, 19 Drawing Sheets

(a)

(b)

(a)

(b)

(a)

(b)

METHOD FOR THE MANUFACTURE OF SMART PAPER AND SMART WOOD MICROFIBERS

This application is a non-provisional application for patent entitled to a filing date and claiming the benefit of earlier-filed Provisional Application for Patent No. 60/863,712, filed on Oct. 31, 2006 under 37 CFR 1.53 (c).

FIELD OF THE INVENTION

This invention relates to the manufacture of conductive paper and conductive fibers. In particular, this invention relates to a method for improving the manufacture of conductive paper and conductive wood microfibers by means of nanocoating techniques. Specifically, the invention relates to a method and process for making paper and microfibers of enhanced electrical conductivity properties by means of layer-by-layer nanocoating techniques. The invention also relates to a method and process for making optically-active paper and microfibers, as well as magnetically-active paper and microfibers, by means of layer-by-layer nanocoating techniques.

BACKGROUND OF THE INVENTION

Traditional paper manufacture begins with the processing of its primary raw material, which is cellulose fiber. Most woods are made up of roughly 50% cellulose, 30% lignin and 20% of mixtures of aromatic hydrocarbons and hemicellulose carbohydrates. In order to obtain cellulose in usable form for paper manufacture the wood is normally pulped to separate the fibers and remove the impurities. The higher the cellulose content of the resulting pulp and the longer the fibers, the better the quality of the paper. Hardwoods generally contain a higher proportion of cellulose but of shorter fiber length than softwoods, which are more resinous. Lignin acts as the resinous adhesive that holds the fibers together. Cotton, linen, straw, bamboo, certain grasses and hemp are also sometimes used as a source of fiber for papermaking. The pulp used in papermaking is the result of the mechanical or chemical breakdown of fibrous cellulose materials into fibers which, when mixed with water, can be spread as thin layers of matted strands. When the water is removed the layer of fibers remaining is essentially paper. Various materials and chemicals are often added to give the paper a better surface for printing, greater density or extra strength. These materials and chemicals are not always cost effective or environmentally friendly.

In addition to cost and environmental considerations, improvements in paper design, production and quality are currently the paper manufacture industry's highest priorities. Pulping, process chemistry, paper coating and recycling are key areas that can benefit from the nanotechnology field, such as polyelectrolyte layer-by-layer (L-b-L) self-assembly. An environmentally friendly process offered by L-b-L nanoassembly may provide important development to the industry.

In the last decade electrostatic layer-by-layer (L-b-L) self-assembly techniques have been developed as a practical and versatile way of creating thin polymeric films both on large surfaces and on microcores. These techniques allow the design of ultra thin coatings with a precision better than one nanometer, and with defined molecular composition. The method of this invention incorporates the use of these layer-by-layer self-assembly techniques as a key step in a plurality of sequential unit operations designed to manufacture paper and microfibers of improved electrical conductivity. The method of this invention also incorporates the use of these layer-by-layer self-assembly techniques as a key step in a plurality of sequential unit operations designed to manufacture paper and microfibers of improved magnetic properties, as well as paper and microfibers of improved optical properties. It is an object of this invention to provide a method for the manufacture of paper and microfibers of improved electrical conductivity. It is also an object of this invention to provide a cost-effective process for fabricating conductive paper and microfibers using nanotechnology layer-by layer self-assembly techniques. Another object of this invention is to provide an application of nanotechnology layer-by-layer self-assembly techniques to paper manufacture that is particularly suitable to the treatment of wood fibers and lignocellulose pulps containing broken (mill broke) recycled fibers so as to allow the cost-effective use of such pulps in the manufacture of paper and microfibers with enhanced electrical conductivity properties. Another object of this invention is to provide a method and process for making optically-active paper and microfibers by means of nanotechnology layer-by-layer techniques. A further object of this invention is to provide a method and process for making magnetically-active paper and microfibers by means of nanotechnology layer-by-layer techniques. These and other objects of the invention will become apparent from the reading of the description that follows.

SUMMARY OF THE INVENTION

The above objects are achieved by the method of this invention which is based on an application of new nanotechnology techniques to the processing of paper pulps, specifically the use of a new layer-by-layer nanoassembly method for coating pulp and paper fibers in order to improve the performance of the final products and, more specifically, in order to impart improved electrical conductivity properties to the final products (paper or microfibers), as well as in order to impart improved magnetic and/or optical activity properties to said products. Such finished products having such improved properties are often referred to as "smart paper" and "smart microfibers". The method of this invention comprises forming an aqueous pulp of lignocellulose fibers and nanocoating it by alternatively adsorbing onto the fibers multiple consecutively-applied layers of organized ultra thin and oppositely-charged polyelectrolytes, at least one of said polyelectrolytes being an electrically conductive polymer or nanoparticle, and another of said polyelectrolytes having a charge opposite of said electrically conductive polymer or nanoparticle, thereby making a modified aqueous pulp of electrically conductive multi-layer nanocoated lignocellulose fibers; then draining the water out of the modified aqueous pulp to form sheets of electrically conducting ("smart") microfibers. A finished paper may be manufactured by the method of the invention by drying the sheets of electrically conductive multi-layer nanocoated lignocellulose fibers and processing the dried nanocoated sheets to make a finished ("smart") paper having enhanced electrical conductivity.

Smart magnetically-active paper and microfibers, as well as smart optically-active paper and microfibers may be manufactured by similar variations of the method of the invention by using certain magnetically-active polymers or nanoparticles and certain optically-active polymers or nanoparticles instead of the electrically conductive polymers or nanoparticles.

In a preferred embodiment of the invention the starting aqueous pulp of lignocellulose fibers is divided into separate portions which are separately nanocoated by alternatively adsorbing onto the fibers multiple consecutively-applied layers of the electrically conductive polymers or nanoparticles (or certain magnetically-active polymers or nanoparticles, or certain optically-active polymers or nanoparticles) so as to impart a positive charge to one portion and a negative charge to the other portion, then blending the two portions to form a complex aggregate pulp of nanocoated fibers. (If the strength of the finished paper is not an important consideration the negative charge may not be necessary.) The thus modified complex aggregate pulp is subsequently drained and dried to form sheets of multi-layer nanocoated fibers, and then processed to make a smart paper with enhanced electrical, magnetic and/or optical activity properties. One advantage of the method of this invention is that it uses layer-by-layer nanoassembly techniques, which employ aqueous polymer solutions, are easily scaled up to mass production and are environmentally friendly.

DETAILED DESCRIPTION OF THE INVENTION

Figure 1:
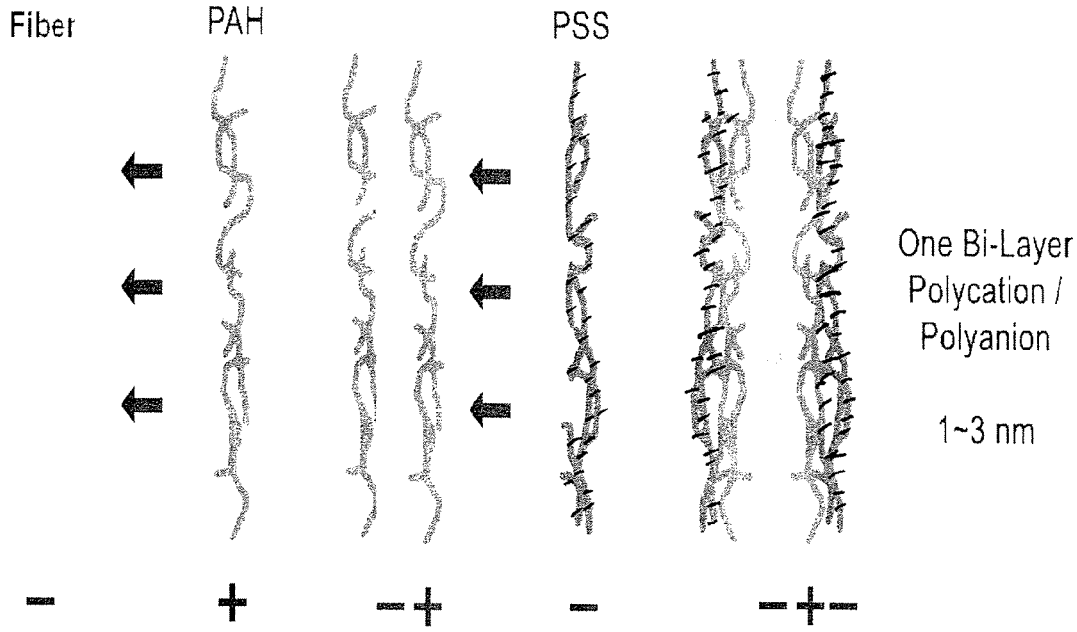
FIG. 1—Cartoon depicting layer-by-layer assembly via alternate adsorption of oppositely charged polyelectrolytes for coating on fiber substrates.

The first step of the method of this invention involves forming an aqueous pulp of lignocellulose fibers. A slurry of between approximately 0.5 and 15% by weight solids is prepared by conventional paper manufacturing techniques using virgin lignocellulose fibers and/or broken (mill broke) recycled fibers. The second step comprises the nanocoating of the aqueous pulp by alternatively impregnating the pulp fibers with multiple consecutively-applied layers of organized ultra thin and oppositely-charged polyelectrolytes, at least one of which is an electrically conductive polymer or nanoparticle and another one of which has a charge opposite the charge of said electrically conductive polymer or nanoparticle. Examples of suitable electrically conductive polymers or nanoparticles are poly(3,4-ethylene-dioxythiophene-poly (styrene sulfonate) (PEDOT-PSS), polypyrrole (PPY), poly (3-hexylthiophene (P3HT), polyaniline, polythiophene, polyphenylene, elemental gold (Au), elemental copper (Cu), elemental silver (Ag), elemental palladium (Pd), elemental zirconium (Zr), elemental chromium (Cr), and carbon nanotubes. Examples of suitable ultra thin polyelectrolytes having a charge opposite of said electrically conductive polymer or nanoparticle are poly(allylamine hydrochloride) (PAH), branched poly(ethyleneimine) (PEI), poly(diallyldimethylammonium chloride) (PDDA) and poly(styrene sulfonate) (PSS).

The ultra thin polyelectrolytes are made available in the form of a solution or dispersion containing the polyelectrolytes. The treatment of the pulp with the solution in order to impregnate the pulp fibers with the solution and cause the polyelectrolytes to be adsorbed onto the fibers is carried out by adding the solution to and mixing it with the pulp thereby causing the alternate adsorption of is oppositely charged polyelectrolytes. The number of adsorbed polyelectrolyte layers is controlled by carrying out the operation so that the ratio of oppositely-charged polyelectrolytes to lignocellulose fibers contained in the aqueous pulp is between about 0.1 and 5% by dry weight of polyelectrolytes and dry weight of fibers. The resulting modified aqueous pulp of multi-layer nanocoated fibers is drained of water utilizing drain screens to form sheets of multi-layer nanocoated fibers. The resulting dried sheets are then processed to make a smart paper that has superior electrical conductivity, magnetic and/or optical properties.

In a preferred embodiment of the invention the starting aqueous pulp of fibers is first divided into two separate portions roughly equal in volume, alternatively impregnating them with the polyelectrolyte solutions, as already described, and causing the adsorption of the oppositely-charged polyelectrolytes on the fibers. The technique involves nanocoating one such portion with multiple consecutively-applied layers of organized ultra thin and oppositely-charged polyelectrolytes so as to impart a positive charge to the outermost layer of the fiber substrate. The other portion is then separately treated in similar fashion but the treatment is carried out so as to impart a negative charge to the outermost layer of the fiber substrate. (If the strength of the finished paper is not an important consideration the negative charge may not be necessary.) The two portions are then blended with each other during the paper making process. The thus modified complex aggregate pulp, which normally exhibits a substantially neutral charge, is subsequently drained and dried to form sheets of multi-layer nanocoated fibers in the manner described above, and then processed to make smart paper with enhanced electrical conductivity, magnetic and/or optical properties.

The coating processes developed prior to the method of this invention include printability improvements, opacity improvements, smoothness, and strength to name a few. These coating processes have in common that they apply a coat to the paper substrate after or during formation of the sheet from the microfibers. The method of this invention provides a systematic layer-by-layer (L-b-L) nanoassembly of conducting polyelectrolyte thin films on lignocellulose microfibers and then integration of such fibers to paper. Pulping, process chemistry, paper coating and recycling are key areas that can benefit from the nanotechnology methods, such as L-b-L nanoassembly and others. As set forth above, nanoassembly (L-b-L) is a unique method based on sequential deposition of oppositely charged polyelectrolytes or nanoparticles on surfaces of different shapes and sizes as shown in FIG. 1. This unique feature of L-b-L has attracted widespread interest of its usage in the field of nanocoating. In the last decade, L-b-L nanoassembly has been developed as a simple, practical and versatile method. It allows creating ultra thin films (in nanometer range) both on large surfaces and on microfibers and cores with the desired composition. The technique has been also used for drug nano-encapsulation, development of biological sensory layers, and carbon nanotube encasing.

The method of this invention applies this technology to lignocellulose wood microfibers for production of electrically conductive paper. For testing our method we have used an aqueous dispersion of anionic poly-(3,4-ethylene-dioxythiophene-poly(styrene sulfonate) (PEDOT-PSS), commercially available as Baytron P from H. C. Stark, and poly (allylamine hydrochloride) (PAH) and poly(ethyleneimine) (PEI) as our cationic polyelectrolytes for L-b-L assembly. By creating organized multiple layers of these polyelectrolytes on a surface of wood microfibers, we have produced a nanocoating that enables the microfibers to exhibit moderate electrical conductivity, and we have found that such electrical conductivity may be controlled by increasing or decreasing the number of conductive polymer layers in the coating. Subsequently, we have used these fibers for the production of hand sheets that have a measurable electrical conductivity. Combining L-b-L nanoassembly and an inkjet printing to form electrically active layers on wood microfibers and paper, electronic devices such as capacitors, inductors, transistors, sensors, communication devices, electromagnetic shields and paper-based displays may be designed.

Figure 2:
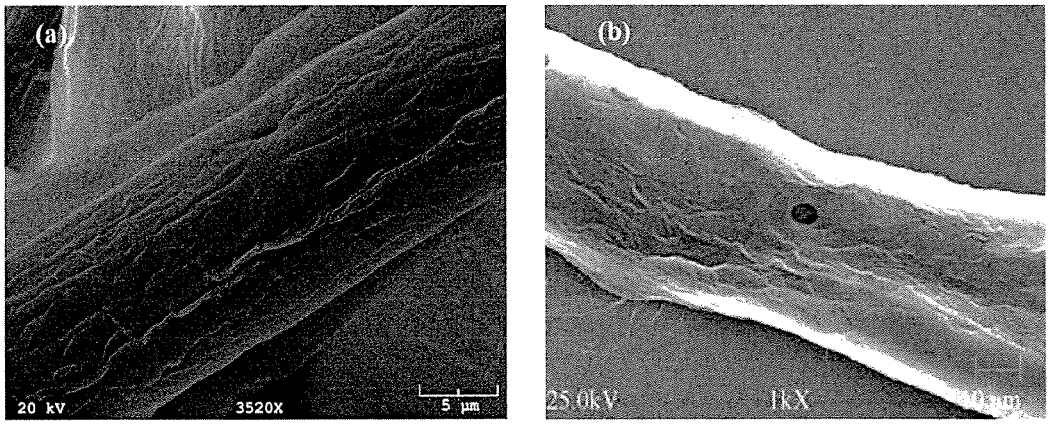
FIG. 2—SEM images of the wood microfiber. (a) Hardwood microfiber; (b) Softwood refined microfiber. (SEM AMREY-1830)

The commercial pulp used in some of the test experiments was beaten bleached Kraft softwood microfibers (less than 1% lignin and more than 99% cellulose), press-dried, and shipped in bundles of 17"×14" sheets, supplied by International Paper Company, Bastrop, La. FIG. 2 shows the scanning electron microscopy (SEM) images of the hardwood and softwood lignocellulose microfibers. The hardwood microfibers are smaller with 1 mm in length and 10-15 μm in diameter, and have thicker cell walls. On the other hand, the softwood microfibers are larger with 3 mm in length and 35-50 μm in diameter, and have thin walls. We made conductive coating on both types of fibers. In the test work set forth below mostly softwood fibers were used for coating conductive polymers to make conducting paper.

The surface potential (Zeta-potential) of PEDOT-PSS complex conducting polymer on $TiO_2$ nanoparticles (25 nm diameter) was measured to be negatively charged, at pH 5 using Brookhaven Zeta Plus micro-electrophoresis instrument. Therefore, different cationic polyelectrolytes such as PAH and PEI were used as an alternate layer with PEDOT-PSS to form the multilayer architecture film using L-b-L assembly. Initially the microfibers were coated with two bilayers of PAH/PSS and PEI/PSS respectively as a precursor to ensure uniform coverage of the substrate. (A bilayer may also be formed by combining any two species from the group consisting of poly(3,4-ethylene-dioxythiophene-poly(styrene sulfonate) (PEDOT-PSS), polypyrrole (PPY), poly-(3-hexylthiophene (P3HT), polyaniline and carbon nanotubes so long as the two chosen species exhibit opposite charges. One such example is a bilayer made by coating a fiber with one PEDOT-PSS and one PPY; another example is a bilayer made by coating a fiber with one P3HT and one PEDOT-PSS; another example is a bilayer made by coating a fiber with one PEDOT-PSS and one carbon nanotube, and so on.) 0.5 M NaCl solutions of polyelectrolytes (PAH and PEI) were also used to coat in alternate with PEDOT-PSS layer to demonstrate their effect on conductivity of the coated microfibers. The surface potential of all the polyelectrolyte coated microfibers was also measured to confirm the formation of the multilayer architecture film on wood microfibers using layer-by-layer process. In case of wood fibers coated with different polycations and PEDOT-PSS polymer, a small amount of short coated fibers were taken and dispersed in deionized water to measure the surface potential. The fibers coated with PEDOT-PSS conducting polymer were negatively charged at pH 5 with potential −40 mV. The PAH and PEI outermost coating on the fibers gave a zeta potential of +35 mV, which confirmed the surface recharging of fibers during alternate polycation-polyanion adsorption in the L-b-L process. The deposition rate of different polycations and PEDOT-PSS conducting polymer on wood microfibers using L-b-L self assembly was observed to be 3 minutes for each monolayer which is in comparison with the earlier reported work on L-b-L assembly on planar substrates. The physical characterization of the microfibers was done using Roughness Step Tester (RST). Thickness of the coated film was estimated using quartz crystal micro-balance (QCM, USI System, Japan) and UV-vis spectroscopy (Agilent). Current-voltage characterization of single microfibers was done using Keithley probe measurement system after each self-assembly of PEDOT-PSS to study the electrical properties of the coated film. After L-b-L assembly of the polyelectrolytes and PEDOT-PSS polymers on lignocellulose microfibers, the hand sheet at 200 g/m$^2$ target basis weight were made at US Department of Forestry, Pineville, La. Hand sheets were made according to Technical Association of Pulp and Paper (TAAPI) T 205T-standard. Tensile test of the prepared hand sheets were done on 2.5 cm wide and 15 cm long specimens. Two test strips were used according to TAPPI T494-014-88 standard using a *Lorentzen & Wettre* Tensile Tester (Model ALWETRON TH1). Degradation analysis of the conducting hand sheet was done over the period of several months by measuring the conductivity at room temperature each time and comparing it with the initial conductivity (relative humidity of the testing room was measured to be in between 40-44% during all the measurements performed).

Figure 3:
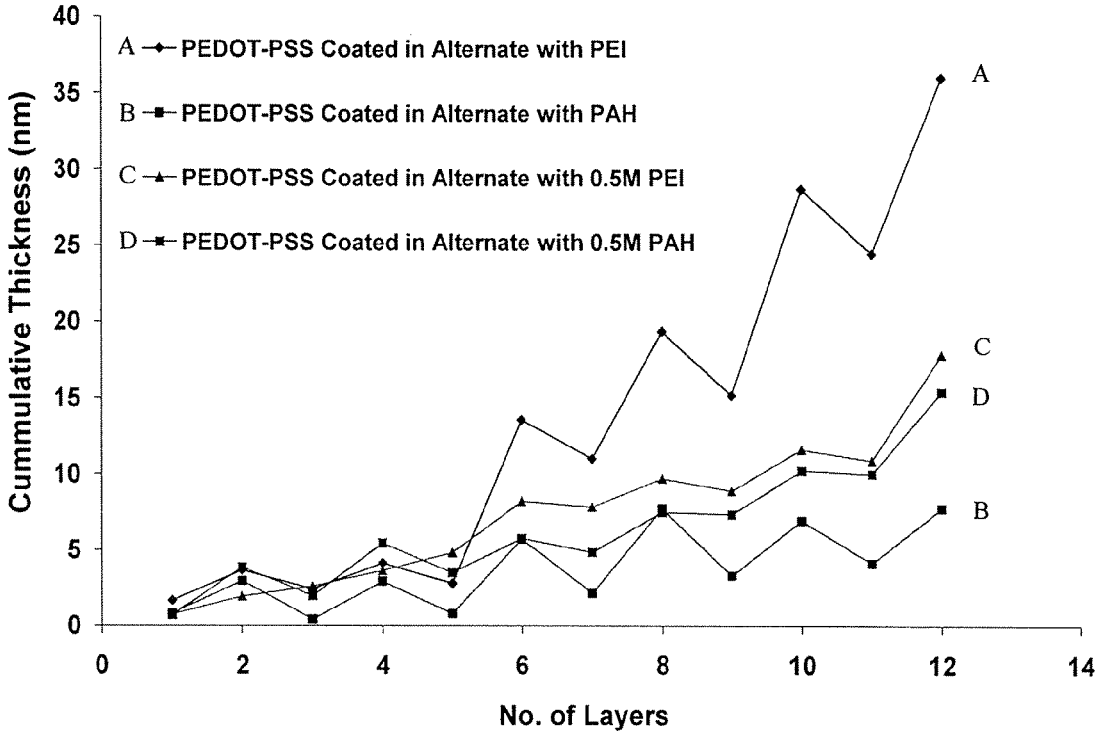
FIG. 3—Plot of thickness of the L-b-L coated films determined using Quartz Crystal Microbalance (9 MHz QCM Instrument, USI-System, Japan).

The assembly conditions were elaborated on silver quartz crystal microbalance (QCM) resonators by monitoring the process by weight addition on every deposition cycle. A resonance frequency shift of the L-b-L coated QCM-resonator enabled us to precisely calculate the thickness of the deposited multilayer. The plot in FIG. 3 shows a stable exponential growth of films on QCM resonators when coated with alternate layers of PEDOT-PSS/polycation. Unlike other polycation, thicker film of PEDOT-PSS was formed during L-b-L process when alternated with PEI polycation. An increment of 9 nm for every deposited bilayer of PEI/PEDOT-PSS was observed during L-b-L process on QCM (which for three bilayers gives total coating thickness of 30 nm). On the other hand, using UV-vis analysis it was observed that approximately 550 mg of PEDOT-PSS per 1 gram of wood microfibers is consumed after three bilayers coated which is approximately twice more than the amount measured by QCM. Better PEDOT-PSS/PEI deposition on the fibers may be explained by a rough surface of the fibers as compared with QCM electrode. These results show that using L-b-L assembly, controlled step-wise deposition of ultra thin conducting layer can be formed on the lignocellulose microfiber surface.

Figure 4:
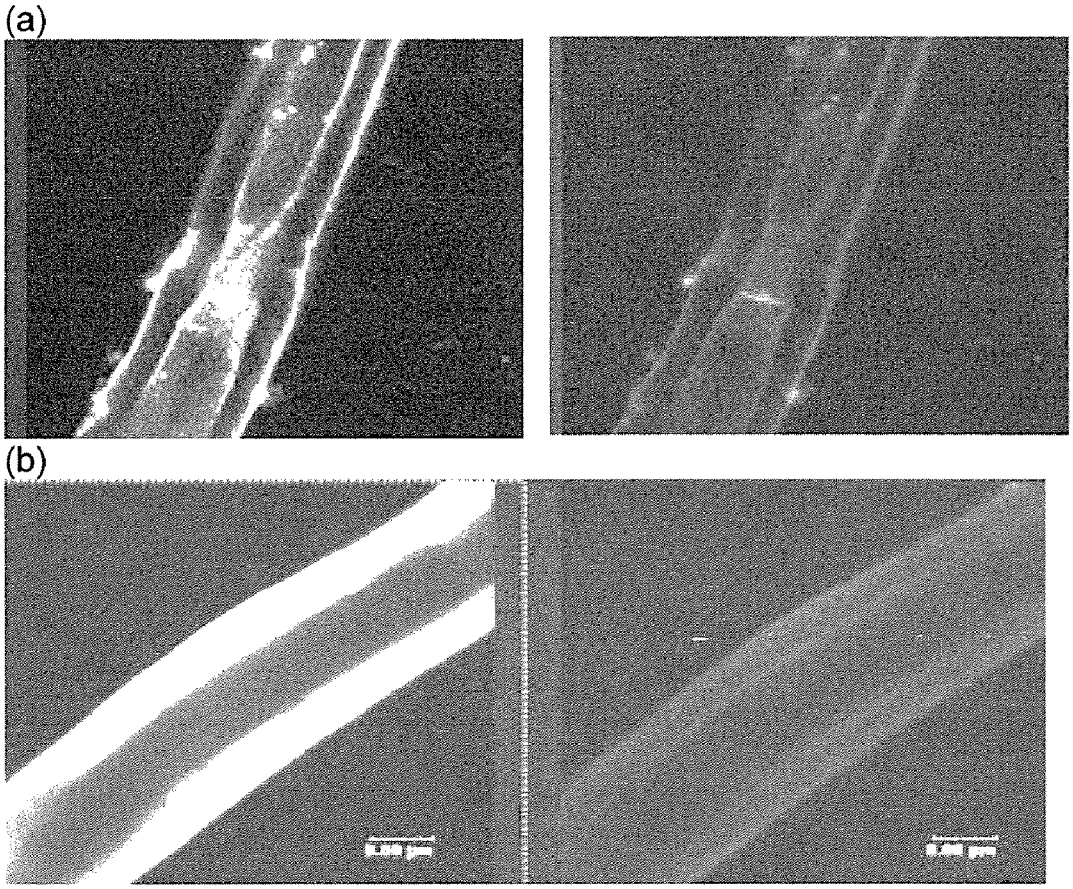
FIG. 4—Confocal images of the wood microfiber coated in alternate (a) PAH-FITC and PEDOT-PSS-RBITC; (b) PEI-FITC and PEDOT-PSS-RBITC. Leica TCS SP Confocal Laser Fluorescent microscope (Leica, Germany)
Figure 5:
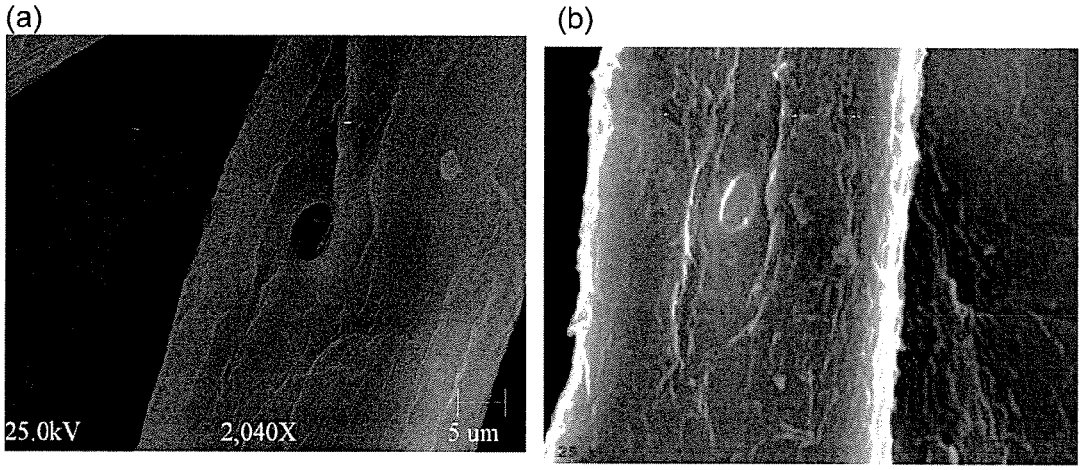
FIG. 5—SEM micrograph of the wood microfibers (a) Uncoated microfiber; (b) Microfibers coated with 4 bilayers of PEI & PEDOT-PSS polymers. (SEM Amrey-1830)

Confocal images of the microfibers coated with alternate polyelectrolytes are shown in FIG. 4. Labeled PEDOT-PSS polyelectrolyte was used in alternate with labeled PAH and PEI polyelectrolytes to perform the L-b-L assembly on wood microfibers. FIG. 4*a* shows the florescent images of the wood fibers coated with a layer of PAH labeled with FITC (green) and alternate layer of PEDOT-PSS labeled with RBITC (red). FIG. 4*b* shows the florescent images of the wood fibers coated with a layer of PEI labeled with FITC (green) and alternate layer of PEDOT-PSS labeled with RBITC (red). This result confirms that the L-b-L technique works on wood microfiber substrate and alternate layers of electrolytes with opposite charge can be coated on its surface. The SEM micrographs of the uncoated and PEDOT-PSS conductive polymer coated (using L-b-L assembly) wood microfibers are shown in FIGS. 5*a* and 5*b*, respectively.

Figure 6:
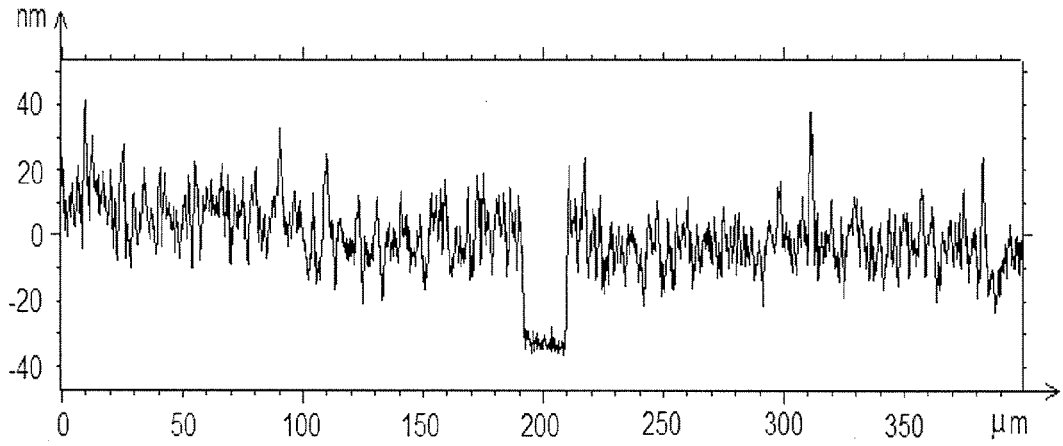
FIG. 6—PEI/PEDOT-PSS film coated on glass substrate for surface characterization (a) Step profile; (b) Surface profile measured using AFM. (Atomic Force Microscope, Quesant Instruments)
Figure 6:
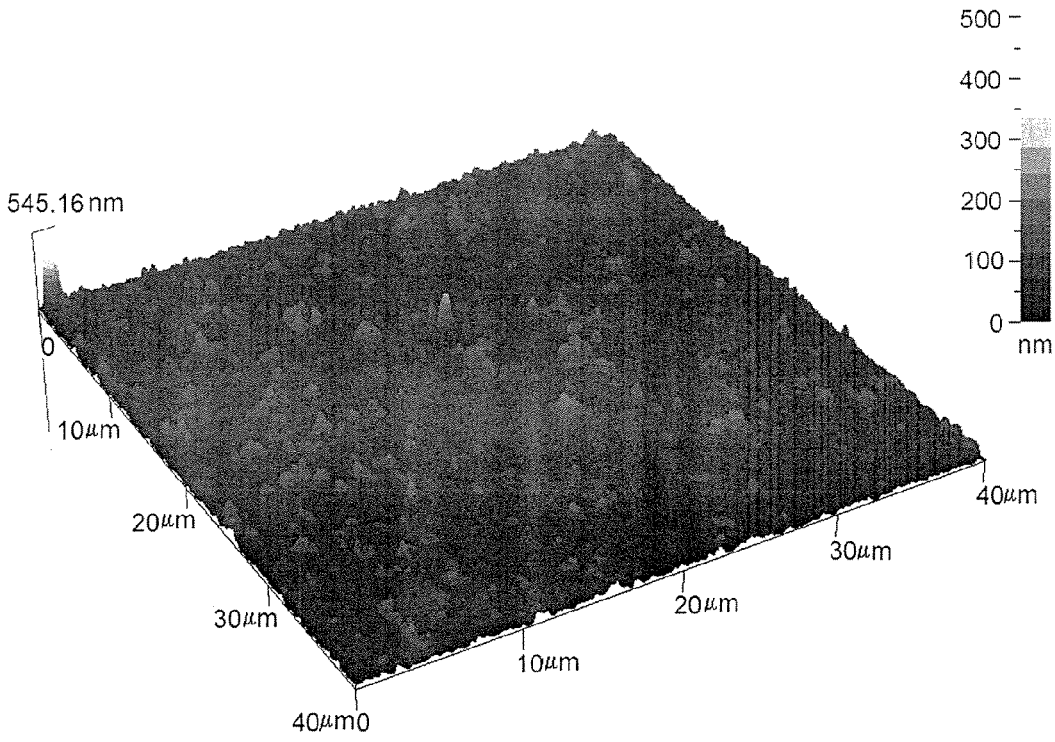

The surface characterization of PEI/PEDOT-PSS coated film on wood microfibers was difficult to perform due the non-uniform geometrical structure of the fibers used. Instead a glass substrate coated with four bilayers of PEDOT-PSS and PEI using L-b-L assembly was used to perform the roughness and step profile analysis of the deposited film. FIG. 6*a* shows the step profile of the film measured using KLA-Tencor step profilometer and FIG. 6*b* shows the surface profile of the film measured using AFM. From FIG. 6*a*, the total thickness of the film formed by 4-bilayer was measured to be 35 nm confirming the thickness obtained using QCM analysis (FIG. 3). The roughness of the 4-bilayer PEI/PEDOT-PSS film (FIG. 6*b*) was measured to be less than 20 nm (roughness of plain glass surface was measured to be 10-15 nm).

Figure 7:
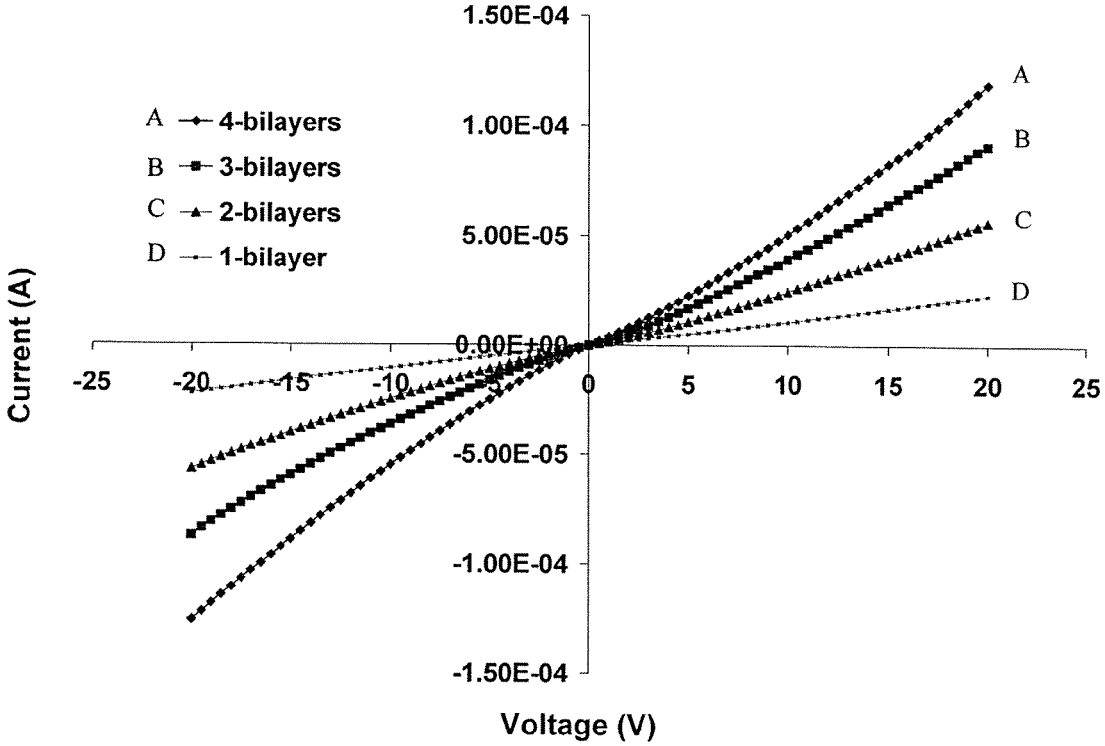
FIG. 7—Plot of I-V Characteristics of beaten wood fibers coated with PEDOT-PSS in alternate with PEI suing L-b-L assembly. (Electrical Probe Station, Keithley Instruments)
Figure 8:
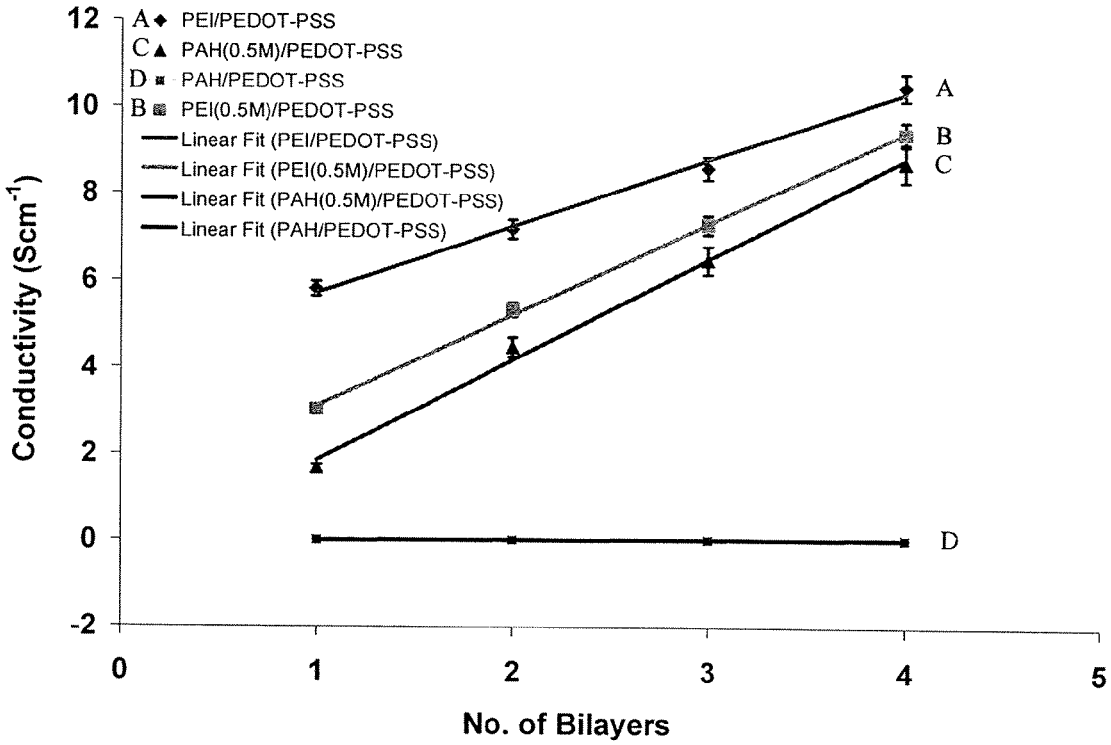
FIG. 8—Plot of conductivity vs. number of bilayers coated on beaten wood fiber with PEDOT-PSS & other polycations using layer-by-layer assembly.

FIG. 7 shows the current-voltage characteristics of the wood microfibers after each bilayer of PEI and PEDOT-PSS had been deposited. It can be observed from FIG. 7 that after each bilayer of PEI/PEDOT-PSS coated on fibers, the slope of the current-voltage line increases indicating decrease in resistance of the coated wood microfibers. FIG. 8 shows the conductivity versus number of bilayers when PEDOT-PSS is coated in alternate with different polycations such as PAH, PAH (0.5 M NaCl), PEI, and PEI (0.5 M NaCl). It was observed that the PEDOT-PSS coated wood microfibers in alternate with PEI polycation exhibit highest conductivity among the samples prepared. This is a result of denser coating, which is formed when PEDOT-PSS is coated in alternation with PEI. (Density, in this context, refers to how much weight of polyelectrolyte is attached to a single layer of fiber.)

Figure 9:
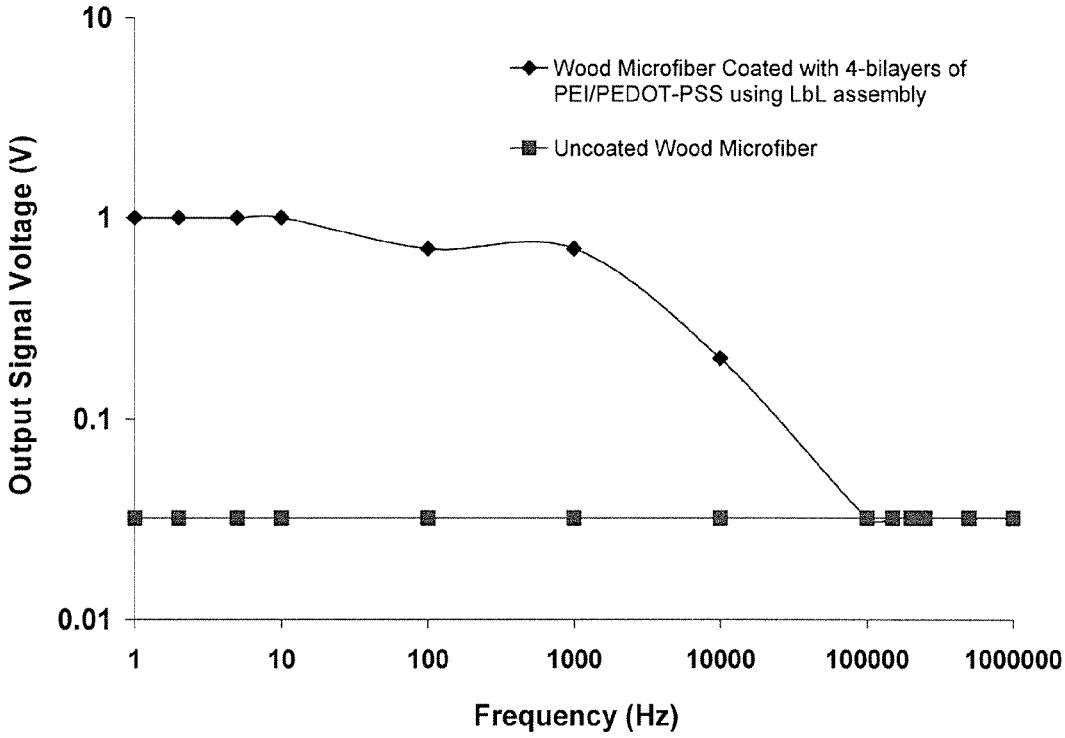
FIG. 9—Plot of (a) Frequency response; (b) Simple equivalent circuit representing the conductive wood fiber.
Figure 9B:
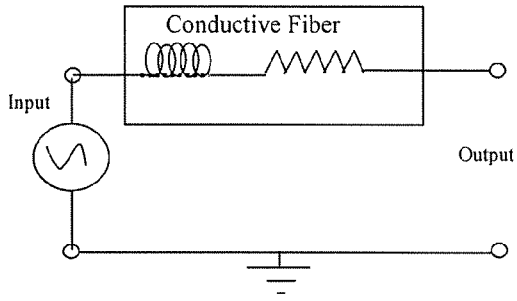

A fiber coated with 4-bilayers of PEI/PEDOT-PSS was tested for its frequency response. FIG. 9*a* gives the output signal amplitude obtained from the fiber when a square wave of 2 v peak to peak signal amplitude was given as input. The response in FIG. 9*a* resembles the characteristics of a low-pass filter. We believe that the physical features (e.g., holes) of the wood microfiber and its layers of conductive coating give rise to inductance characteristics. A resulting simple equivalent circuit of the PEI/PEDOT-PSS coated microfiber is given in FIG. 9*b*, where the impedance of the coated fiber is given by $Z=R+j\omega L$ (where 'R' is the resistance and 'L' is the inductance of the coated microfiber, and '$\omega$' is the input signal frequency). At low frequencies ($\omega$) the impedance (Z) is low and the amplitude of the resulting output signal is high (FIG. 9*a*), whereas at higher frequencies ($\omega$) the amplitude of the output signal decreases (FIG. 9*a*) due to increase in the impedance value (Z). This result is indicative of the realization electronic devices on wood microfibers and their integration into the resulting paper.

Figure 10:
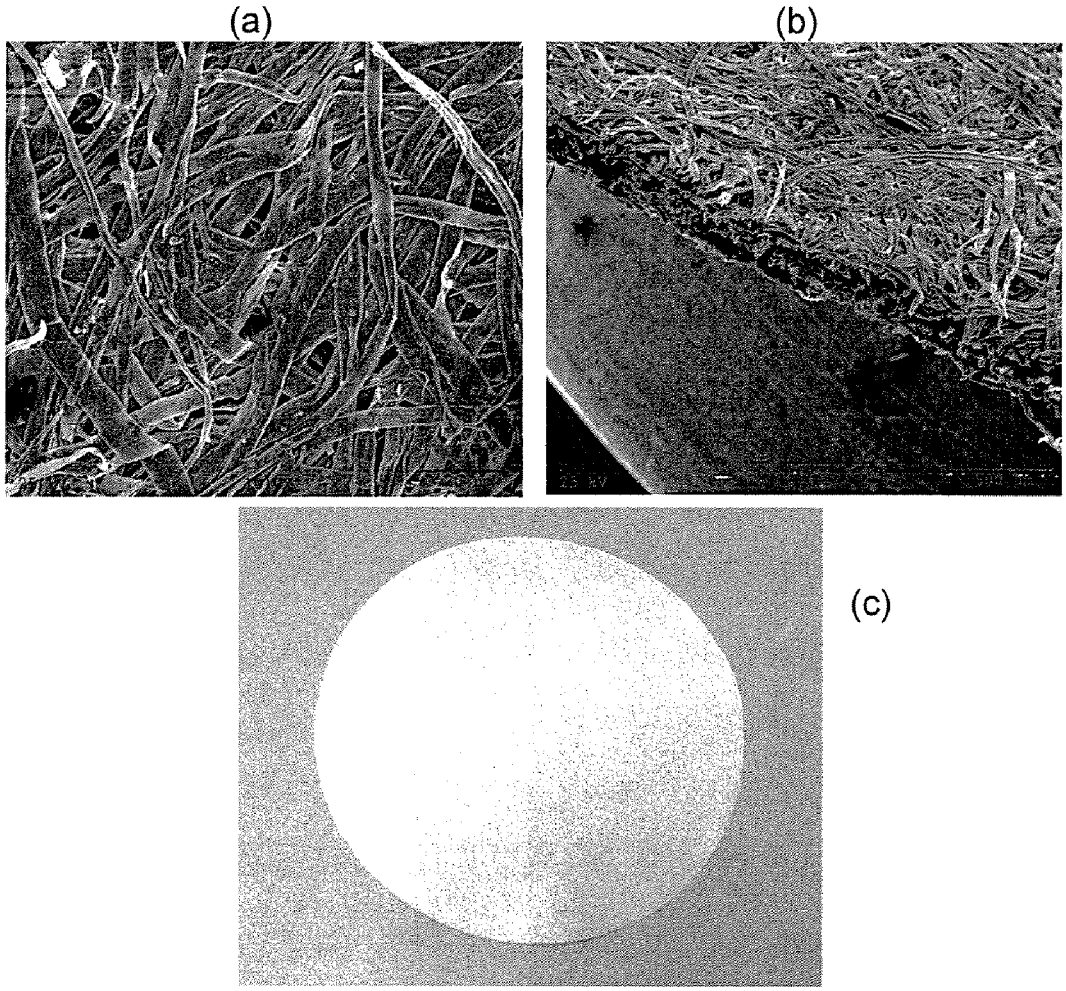
FIG. 10—(a) SEM micrograph of the hand sheet prepared using wood microfibers coated with four layers of PEDOT-PSS in alternate with PEI; (b) SEM micrograph of the hand sheet edge (SEM AMREY-1830); (c) Photographic image of the full hand sheet of 6" diameter.
Figure 11:
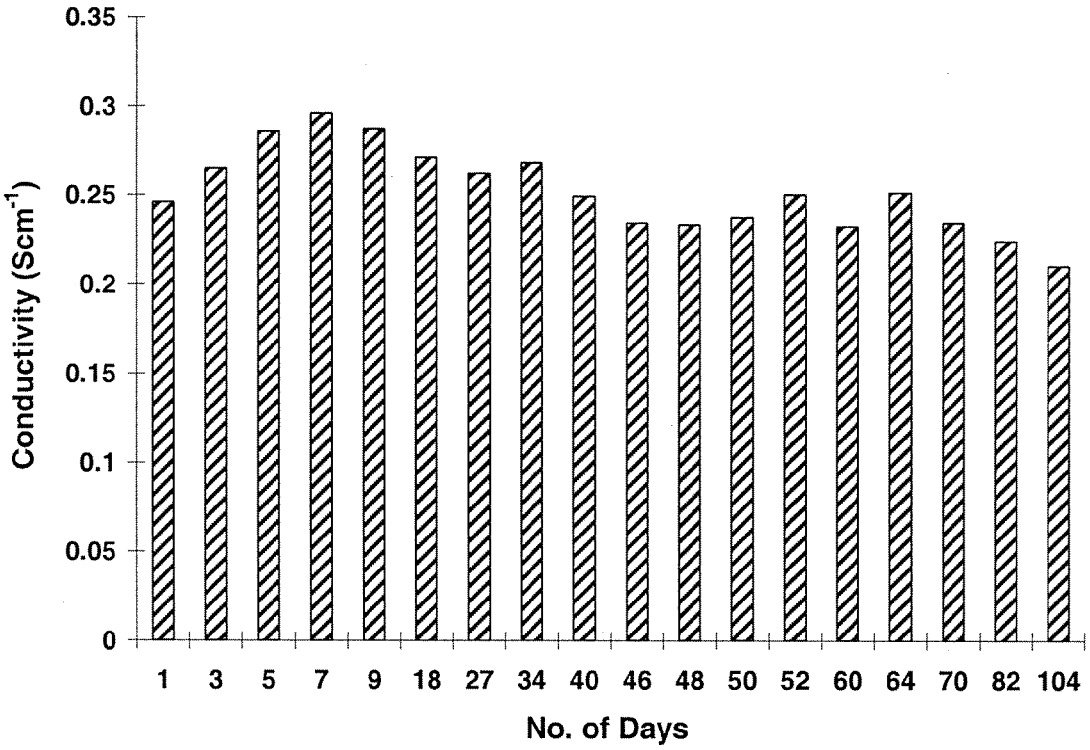
FIG. 11—Bar graph of conductivity of hand sheet made from wood microfibers coated with four layers of PEDOT-PSS using L-b-L assembly in alternate with PEI cationic polyelectrolyte.
Figure 12:
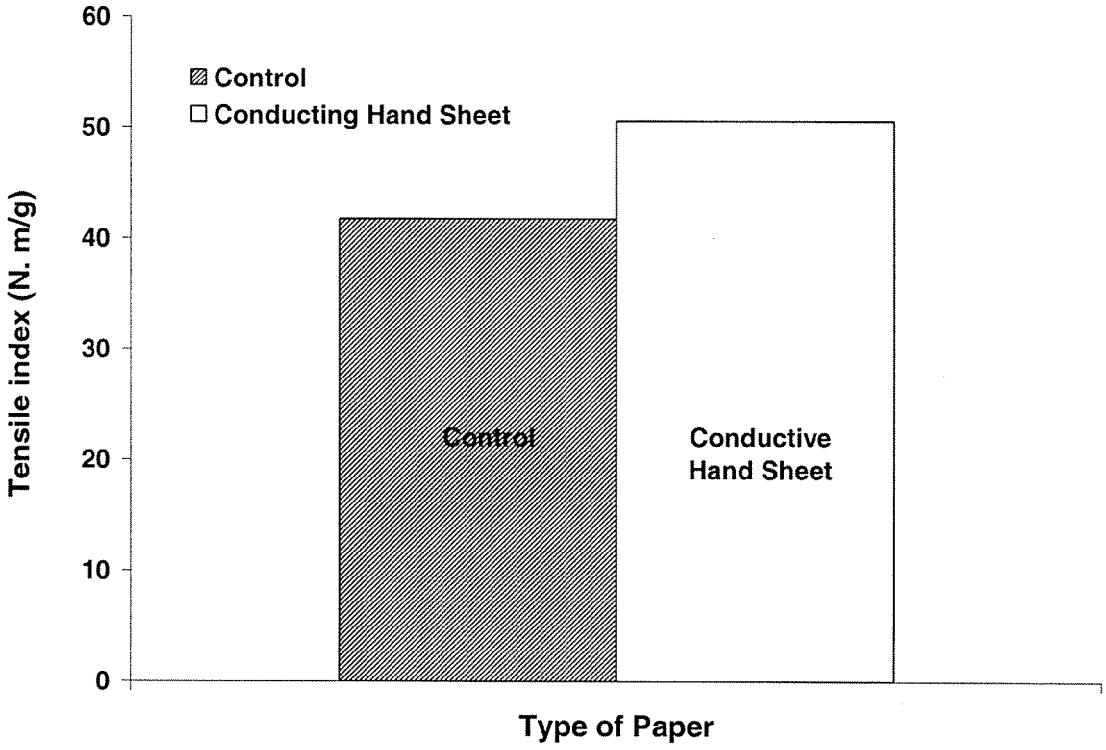
FIG. 12—Bar graph of tensile Strength (TAPPI standard) test of the hand sheet prepared from PEDOT-PSS/PEI coated pulp microfibers.
Figure 13:
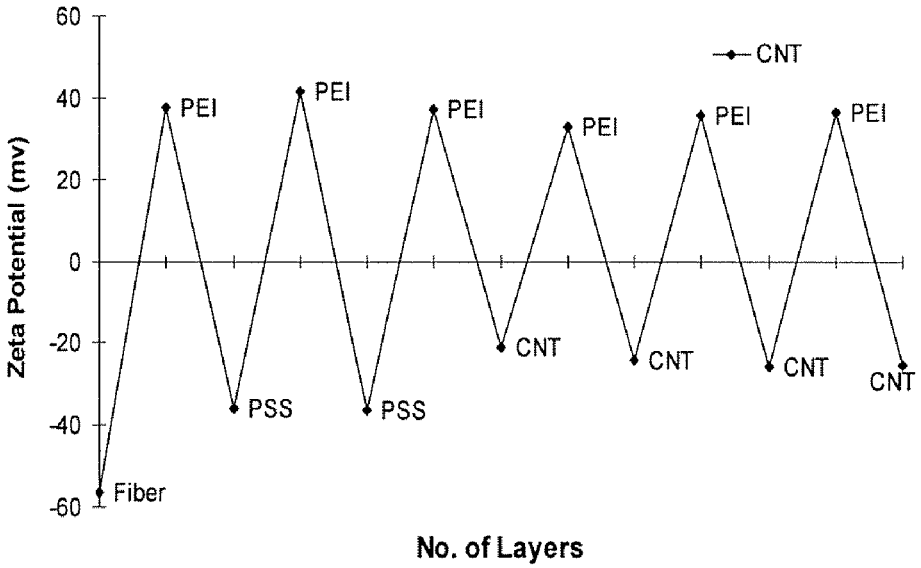
FIG. 13—Plot of Zeta-potential results (a) when a layer of carbon nanotubes is coated in alternate with a layer of PEI, and (b) when a bilayer of carbon nanotubes and PEI is coated in alternate with a bilayer of PEDOT-PSS.
Figure 13:
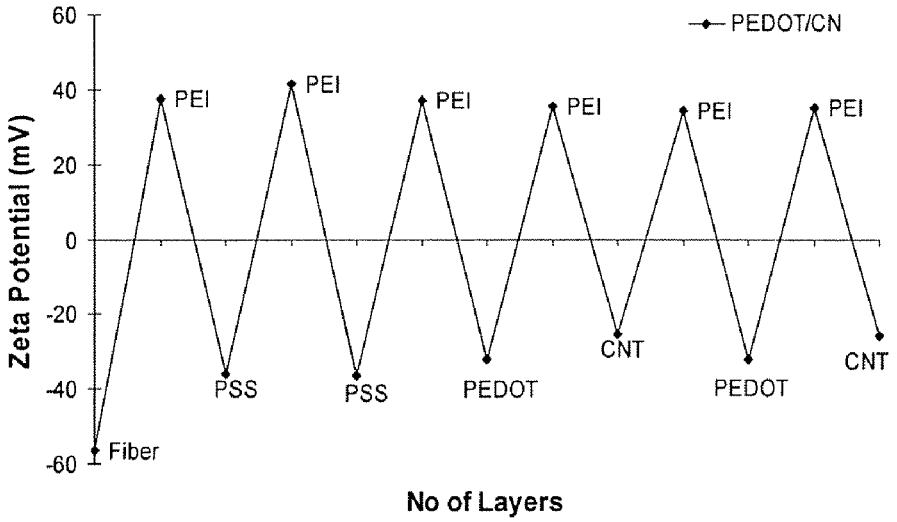

The hand sheets at 200 g/m$^2$ target basis weight using wood microfiber, coated with 4 bilayers of PEI/PEDOT-PSS, were made at US Department of Forestry. The SEM micrograph of the conductive hand sheet is shown in FIGS. 10*a* and 10*b*. The photographic image of the hand sheet is shown in FIG. 10*c*. The conductivity of the hand sheet was calculated by measuring current-voltage characteristics using a Keithley measurement system and is given in FIG. 11. This figure also shows the conductivity of the hand sheet measured over certain period of time in order to check the degradation of the polymer coated on the wood fibers to make the hand sheet. From degradation analysis, it has been determined that the nanocoating of PEDOT-PSS on paper remains stable over several days. The change in conductivity of the PEDOT-PSS film was determined to be within 10% over a period of six months. With regard to the strength of the conducting paper, the tensile test results are shown FIG. 12. The control hand sheet was made from wood fiber without any coating. From the results shown in FIG. 12, it can be concluded that the conducting hand sheet coated with PEDOT-PSS has higher tensile index value than a control hand sheet made from virgin uncoated fibers. The degradation and tensile strength analyses show that a stable conductive paper can be made by coating conducting polymer PEDOT-PSS, using layer-by-layer assembly techniques, on wood microfibers right at the beginning of the paper making process. An addition of different amounts of conductive fibers to virgin fibers allows the production of paper with controlled conductivity. A minimal amount of 25% conductive fibers in the mixture with virgin fibers was preferred in order to provide good bulk paper conductivity. It is surmised that a minimal amount such as this may be needed in order to provide a permanent network of conductive fibers through the paper sheets.

The smart conducting paper made by the method of this invention may be used in many commercial applications, such as realizing security documents and graphic arts directly on paper. The conductive paper may be employed in the development of smart paper technology based on monitoring of electrical, optical and other signals. Paper coated with sensory layers, such as $TiO_2$ nanoparticles, may also be applied to detect the concentration of ethylene, emitted by climacteric fruits.

As set forth above, a novel method of achieving controlled conductive coating on lignocellulose microfibers and paper using a layer-by-layer nanoassembly is provided by the method of this invention. The conductivity of the coated fibers and paper can be controlled in the range of $10^{-3}$ to 10 siemens, depending on the type of the fibers and a number of deposited molecular layers of the polythiophene. From degradation analysis, it has been found that the nanocoating of the conducting polymer (PEDOT-PSS) remains stable over at least six months. The electrical response of L-b-L nanocoated single fiber resembles the characteristics of a low-pass filter with drop of the output amplitude above 2 KHz. Conductive paper was produced from PEDOT-PSS L-b-L coated fibers. Nanocoated wood microfibers and paper may be applied to make electronic devices, such as capacitors, inductors, and transistors fabricated on cost-effective lignocellulose pulp. The use of conductive nanocoating on wood fibers can open the door for future development of smart paper technology, applied as sensors, communication devices, electromagnetic shields and paper-based displays.

Figure 14:
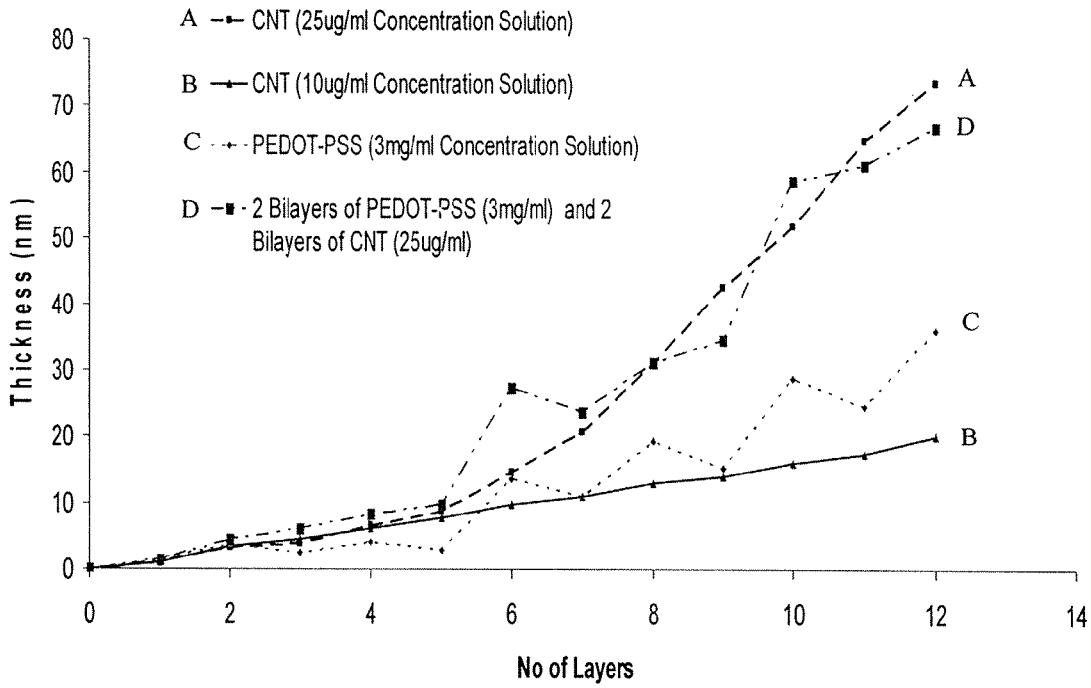
FIG. 14—Plot of thickness of the coated carbon nanotube films using 5, and 25 μg/ml solutions, PEDOT-PSS using 3 mg/ml solution, and a bilayer of PEDOT-PSS/PEI coated in alternate with a bilayer of carbon nanotubes, as calculated using quartz crystal micro-balance (QCM).
Figure 15:
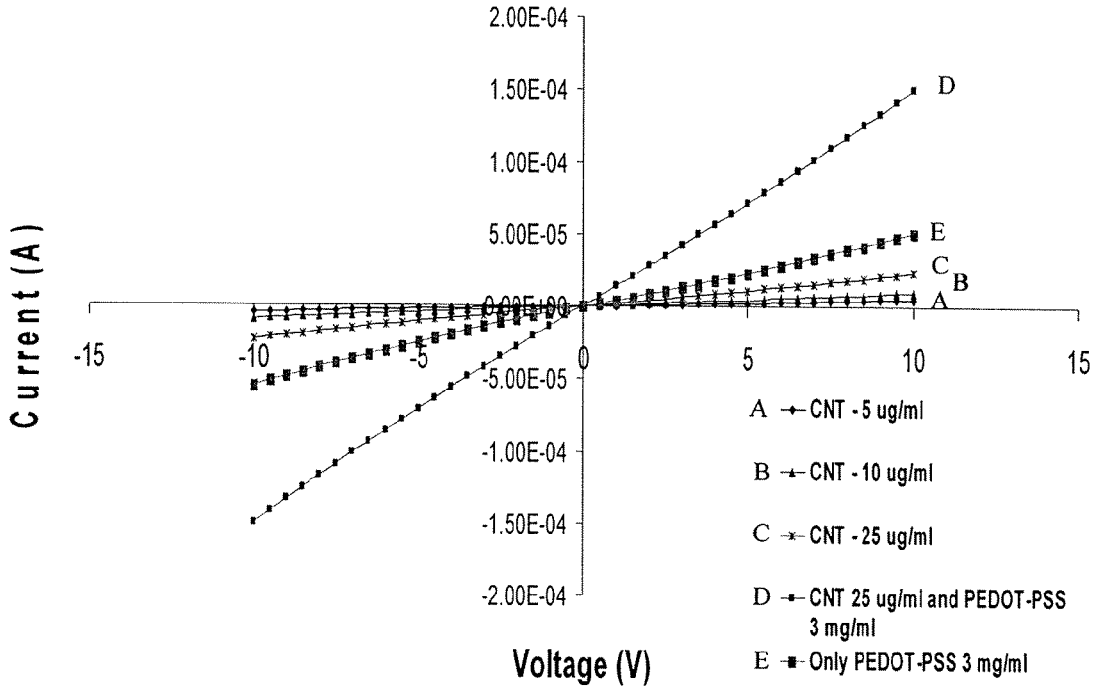
FIG. 15—Plot of measured I-V characteristics for wood microfibers coated with four bilayers of carbon nanotubes solution consisting of 5, 10 and 25 μg/ml concentrations of carbon nanotubes, PEDOT-PSS using 3 mg/ml solution, and two bilayer of PEDOT-PSS/PEI coated in alternate with two bilayer of carbon nanotubes (25 μg/ml solution).
Figure 16:
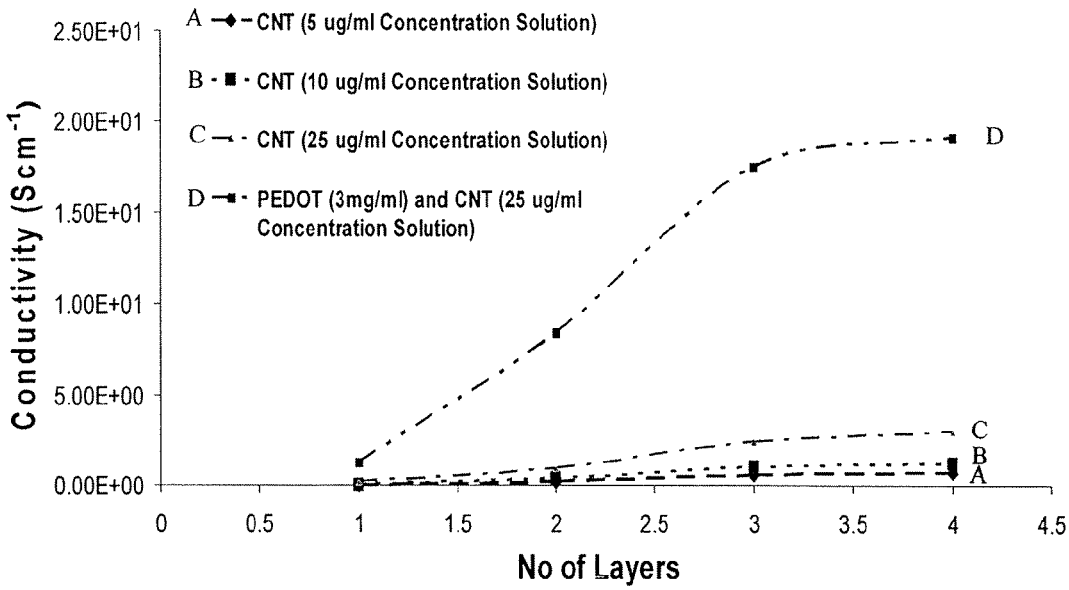
FIG. 16—Plot of conductivity of microfibers coated with different species of bilayers (carbon nanotubes solution consisting of 5, 10 and 25 μg/ml concentrations of carbon nanotubes, PEDOT-PSS using 3 mg/ml solution, and two bilayers of PEDOT-PSS/PEI coated in alternate with two bilayers of carbon nanotubes-25 μg/ml solution) versus number of bilayers.

FIGS. 13, 14, 15 and 16 illustrate a role of carbon nanotubes in the method of this invention. Thus, in FIG. 13 Zeta-potential results are shown when a layer of carbon nanotubes is coated in alternate with a layer of PEI, as well as when a bilayer of carbon nanotubes and PEI is coated in alternate with a bilayer of PEDOT-PSS. The surface charge of all the polyelectrolytes was measured using Brookhaven Zeta Plus micro-electrophoresis instrument (z-potential). Initially, the microfibers were coated with two precursor bilayers of PEI/PSS to initiate the L-b-L process and ensure uniform coverage of the substrate. FIG. 13*a* shows that a layer of carbon nanotubes can be coated in alternate with a layer PEI using layer-by-layer assembly. A total of four bilayers of carbon nanotubes and PEI have been coated in this case. FIG. 13*b* shows that a bilayer of carbon nanotubes and PEI is coated in alternate with a bilayer of PEDOT-PSS. A total of two bilayers of PEDOT-PSS/PEI and two bilayers of carbon nanotubes/PEI have been coated in this case. The thickness of the coated carbon nanotube films using 5, 10 and 25 μg/ml solutions, PEDOT-PSS using 3 mg/ml solution, and a bilayer of PEDOT-PSS/PEI coated in alternate with a bilayer of carbon nanotubes were calculated using quartz crystal micro-balance (QCM) are shown in FIG. 14. FIG. 15 shows the measured I-V characteristics for wood microfibers coated with four bilayers of carbon nanotubes solution consisting of 5, 10 and 25 μg/ml concentrations of carbon nanotubes, PEDOT-PSS using 3 mg/ml solution, and two bilayer of PEDOT-PSS/PEI coated in alternate with two bilayer of carbon nanotubes (25 μg/ml solution). It can be observed that as the concentration of the carbon nanotube solution increases, the slope of the I-V curve increases, indicating decrease in resistance. Also, the resistance of the fibers decreases dramatically when a bilayer of PEDOT-PSS is coated in alternate with a bilayer of carbon nanotubes. This is due to the conduction path provided by PEDOT-PSS to carbon nanotubes. FIG. 16 shows the conductivity of microfibers coated with different species of bilayers (carbon nanotubes solution consisting of 5, 10 and 25 μg/ml concentrations of carbon nanotubes, PEDOT-PSS using 3 mg/ml solution, and two bilayers of PEDOT-PSS/PEI coated in alternate with two bilayers of carbon nanotubes-25 μg/ml solution) versus the number of bilayers. It can be noted that, initially, the conductivity of the fibers increases as the number of bilayers increases. This may be attributed to the nature of very thin films: when the coating is too thin there may not be a direct path for conduction, or there may be a surface effect (e.g., density) due to which the conductivity does not remain constant when the fibers are coated with initial bilayers.

Figure 17:
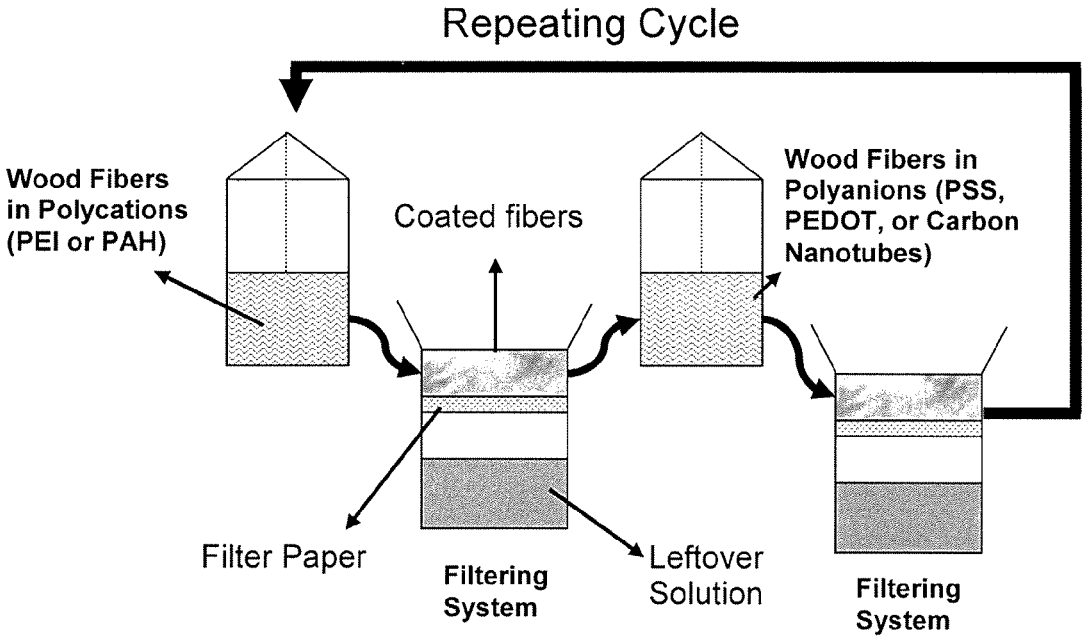
FIG. 17—Equipment setup for coating polyelectrolytes on pulp wood microfibers.

The equipment setup for coating nano-layers of polymer materials or nanoparticles is depicted in FIG. 17. First the fibers are soaked in polycations solution (normal water or 0.1 M NaOH water) consisting of either PEI or PAH. After coating the fiber with a layer of polycations, the slurry of fibers goes through a filtering system where excess solution is filtered out and the fibers are then soaked in a solution of polyanions consisting of PEDOT-PSS or carbon nanotubes. The cycle of coating polycations and polyanions is repeated until the desired numbers of bilayers are coated.

Figure 18:
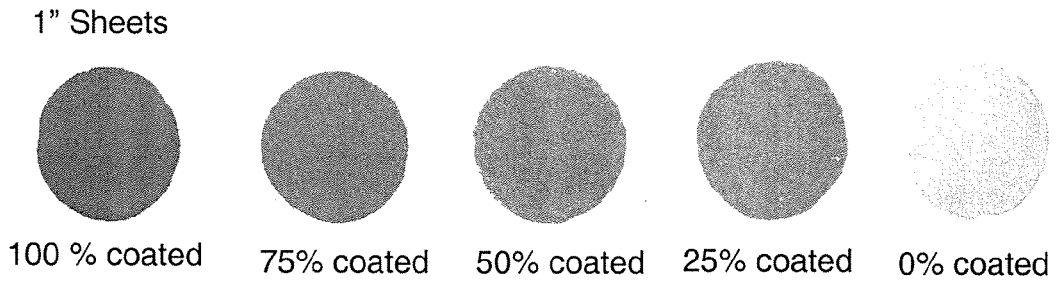
FIG. 18—Photographic image of the hand sheets produced by mixing different concentration of conductive coated fibers and virgin uncoated fibers.
Figure 18:
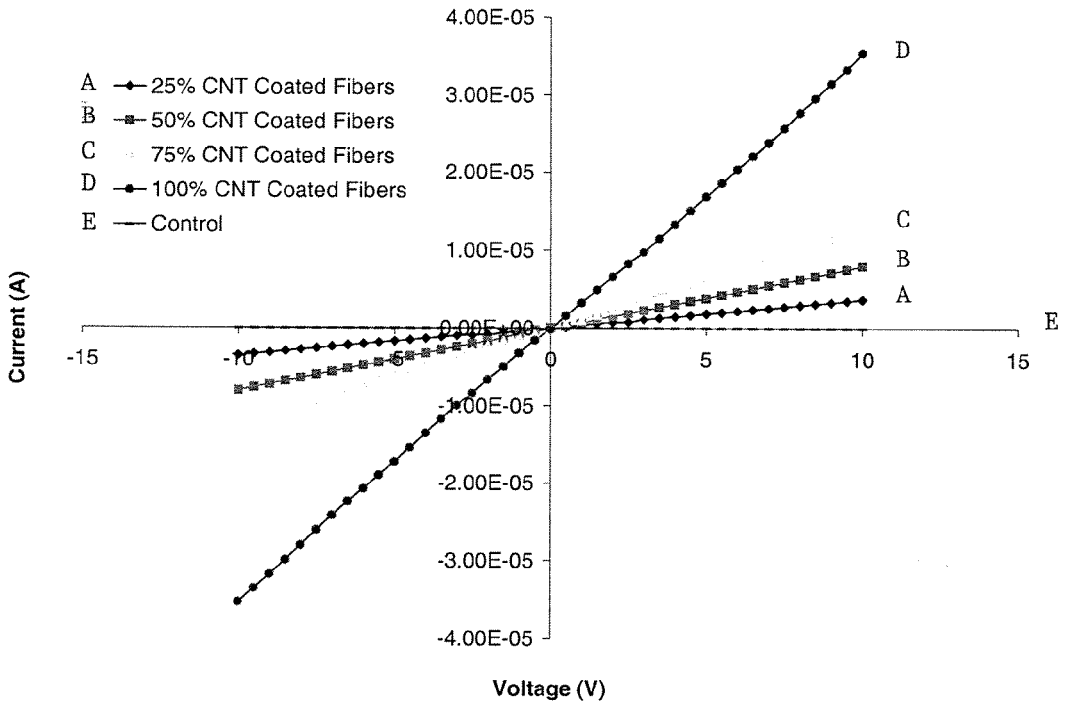

FIG. 18 shows the photographic images of the hand sheets produced by mixing different concentration of conductive coated fibers and virgin uncoated fibers.

Figure 19:
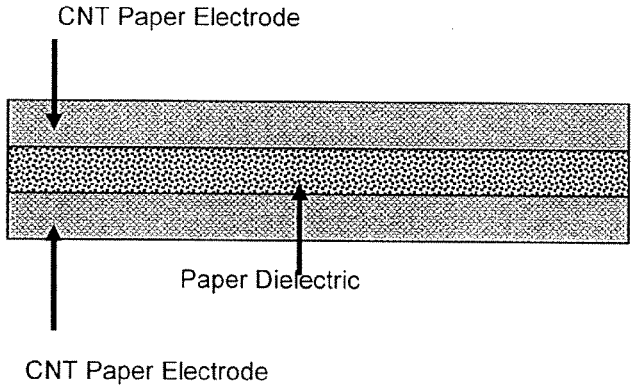
FIG. 19—(a) depiction of a type of paper-based capacitor that may be fabricated using the layers of conductive paper by the method of the invention (b) plot of capacitance versus voltage
Figure 19:
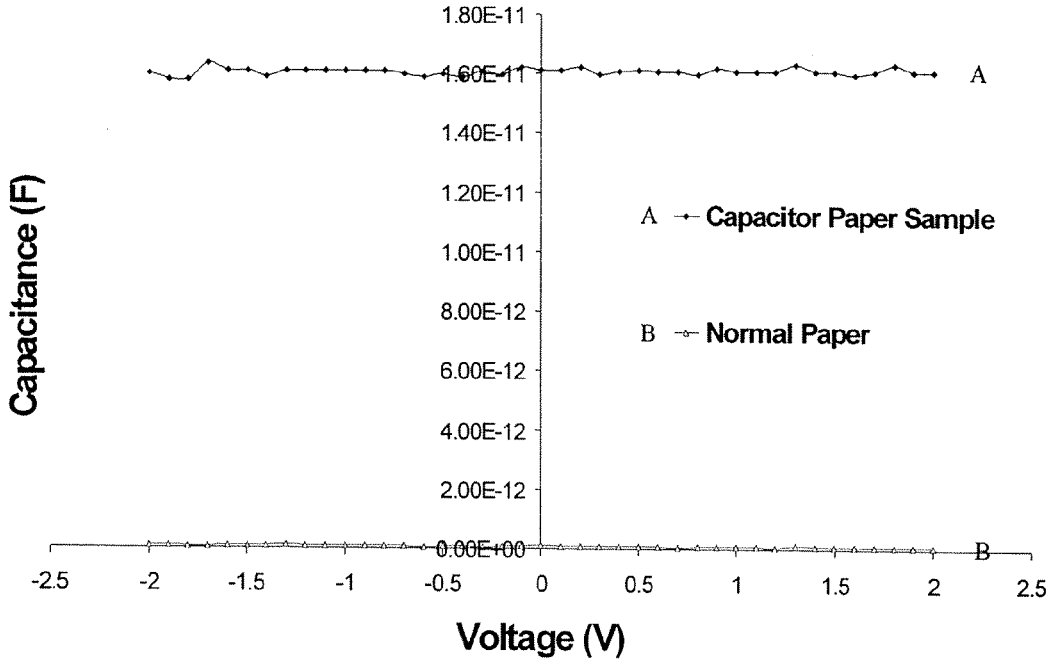

FIG. 19*a* depicts a type of paper-based capacitor that can be fabricated using the layers of conductive paper contemplated by the method of the invention. In this illustration the top and bottom plates of the capacitor are formed using the conductive paper. The dielectric of the capacitor can be a normal uncoated microfibers or microfibers coated with dielectric material such as $SiO_2$ using the same layer-by-layer process. The measured capacitance of the actual paper-based capacitor versus normal paper is shown in FIG. 19*b*.

Following are recitations of slightly different embodiments or variations contemplated by the method of this invention:

$1^{st}$ Embodiment

A method for making electrically conducting wood microfibers, comprising (a) forming an aqueous pulp of lignocellulose fibers; (b) nanocoating said aqueous pulp of lignocellulose fibers by alternatively adsorbing onto the fibers multiple consecutively-applied layers of organized ultra thin and oppositely-charged polyelectrolytes, at least one of said polyelectrolytes being an electrically conductive polymer or nanoparticle, and another of said polyelectrolytes having a charge opposite of said electrically conductive polymer or nanoparticle, thereby making a modified aqueous pulp of electrically conductive multi-layer nanocoated lignocellulose fibers; and (c) draining the water out of the modified aqueous pulp to form electrically conducting wood microfibers. Electrically conductive polymers or nanoparticles are materials which exhibit electrical conductivity or semi conductivity properties. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids.

$2^{nd}$ Embodiment

The method of the $1^{St}$ Embodiment, wherein said electrically conductive polymer or nanoparticle is chosen from the group consisting of poly(3,4-ethylene-dioxythiophene-poly (styrene sulfonate) (PEDOT-PSS), polypyrrole (PPY), poly-(3-hexylthiophene (P3HT), polyaniline, polythiophene, polyphenylene, Au, Cu, Ag, Pd, Zr, Cr, and carbon nanotubes, and said polyelectrolyte having a charge opposite of said electrically conductive polymer or nanoparticle is chosen from the group consisting of poly(allylamine hydrochloride)

(PAH), branched poly(ethyleneimine) (PEI), poly(diallyldimethylammonium chloride) (PDDA) and poly(styrene sulfonate) (PSS).

3rd Embodiment

A method for making electrically conducting paper, comprising (a) forming an aqueous pulp of lignocellulose fibers; (b) nanocoating said aqueous pulp of lignocellulose fibers by alternatively adsorbing onto the fibers multiple consecutively-applied layers of organized ultra thin and oppositely-charged polyelectrolytes, at least one of said polyelectrolytes being an electrically conductive polymer or nanoparticle, and another of said polyelectrolytes having a charge opposite of said electrically conductive polymer or nanoparticle, thereby making a modified aqueous pulp of electrically conductive multi-layer nanocoated lignocellulose fibers; (c) draining the water out of the modified aqueous pulp to form sheets of electrically conductive multi-layer nanocoated lignocellulose fibers; (d) drying said formed sheets of electrically conductive multi-layer nanocoated lignocellulose fibers; and (e) processing the dried nanocoated sheets to make a finished paper having enhanced electrical conductivity. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids.

4th Embodiment

The method of the 3rd Embodiment, wherein said electrically conductive polymer or nanoparticle is chosen from the group consisting of poly(3,4-ethylene-dioxythiophene-poly(styrene sulfonate) (PEDOT-PSS), polypyrrole (PPY), poly-(3-hexylthiophene (P3HT), polyaniline, polythiophene, polyphenylene, Au, Cu, Ag, Pd, Zr, Cr, and carbon nanotubes, and said polyelectrolyte having a charge opposite of said electrically conductive polymer or nanoparticle is chosen from the group consisting of poly(allylamine hydrochloride) (PAH), branched poly(ethyleneimine) (PEI), poly(diallyldimethylammonium chloride) (PDDA) and poly(styrene sulfonate) (PSS).

5th Embodiment

A method for making electrically conducting paper, comprising (a) forming an aqueous pulp of lignocellulose fibers; (b) nanocoating a first portion of said aqueous pulp of lignocellulose fibers by alternatively adsorbing onto the fibers multiple consecutively-applied layers of organized ultra thin and oppositely-charged electrically conductive polymers or nanoparticles selected from the group consisting of poly(3,4-ethylene-dioxythiophene-poly(styrene sulfonate) (PEDOT-PSS), polypyrrole (PPY), poly-(3-hexylthiophene (P3HT), polyaniline, polythiophene, polyphenylene, Au, Cu, Ag, Pd, Zr, Cr, $SnO_2$, $ZrO_2$, $Al_2O_3$ and carbon nanotubes, thereby making a first charged modified aqueous pulp of electrically conductive multi-layer nanocoated lignocellulose fibers; (this first portion must be electrically conductive) (c) separately nanocoating a second portion of said aqueous pulp of lignocellulose fibers by alternatively adsorbing onto the fibers multiple consecutively-applied layers of organized ultra thin and oppositely-charged polyelectrolytes selected from the group consisting of poly(allylamine hydrochloride) (PAH), branched poly(ethyleneimine) (PEI), poly(diallyldimethylammonium chloride) (PDDA) and poly(styrene sulfonate) (PSS), thereby making a second oppositely-charged modified aqueous pulp of multi-layer nanocoated lignocellulose fibers; (this second portion may be but need not be electrically conductive) (d) blending said first charged modified aqueous pulp of electrically conductive multi-layer nanocoated lignocellulose fibers with said second oppositely-charged modified aqueous pulp of multi-layer nanocoated lignocellulose fibers to form a complex aggregate pulp of nanocoated fibers; (e) draining the water out of the complex aggregate pulp of nanocoated fibers to form sheets of electrically conductive multi-layer nanocoated lignocellulose fibers; (f) drying said formed sheets of electrically conductive multi-layer nanocoated lignocellulose fibers; and (g) processing the dried nanocoated sheets to make a finished paper having enhanced electrical conductivity. The nanocoating of the first portion of lignocellulose fiber pulp is preferably carried out consecutively through one adsorption step less than the nanocoating of said second portion of lignocellulose fiber pulp. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably aqueous slurry having between about 0.5 and 15% solids. In a variation of the technique illustrated in this 5th Embodiment, the second portion of the pulp is nanocoated by alternatively adsorbing onto the fibers multiple consecutively-applied layers of organized ultra thin and oppositely-charged polyelectrolytes chosen from any one or more of the polyelectrolytes used to nanocoat the first portion of the aqueous pulp of lignocellulose fibers.

6th Embodiment

A method for making electrically conducting paper, comprising (a) forming an aqueous pulp of lignocellulose fibers; (b) nanocoating a first portion of said aqueous pulp of lignocellulose fibers by alternatively adsorbing onto the fibers multiple consecutively-applied layers of organized ultra thin and oppositely-charged electrically conductive polymers or nanoparticles selected from the group consisting of poly(3,4-ethylene-dioxythiophenepoly(styrene sulfonate) (PEDOT-PSS), polypyrrole (PPY), poly-(3-hexylthiophene (P3HT), polyaniline, polythiophene, polyphenylene, elemental gold (Au), elemental copper (Cu), elemental silver (Ag), elemental palladium (Pd), elemental zirconium (Zr), elemental chromium (Cr), and carbon nanotubes, thereby making a first charged modified aqueous pulp of electrically conductive multi-layer nanocoated lignocellulose fibers; (c) separately providing a second portion of said aqueous pulp of lignocellulose fibers; (d) blending said first charged modified aqueous pulp of electrically conductive multi-layer nanocoated lignocellulose fibers with said second portion of said aqueous pulp of lignocellulose fibers to form a complex aggregate pulp of nanocoated fibers; (e) draining the water out of the complex aggregate pulp of nanocoated fibers to form sheets of electrically conductive multi-layer nanocoated lignocellulose fibers; (f) drying said formed sheets of electrically conductive multi-layer nanocoated lignocellulose fibers; and (g) processing the dried nanocoated sheets to make a finished paper having enhanced electrical conductivity. (The first portion is nanocoated but the second portion is not).

7th Embodiment

A method for making magnetically active wood microfibers, comprising (a) forming an aqueous pulp of lignocellulose fibers; (b) nanocoating said aqueous pulp of lignocellulose fibers by alternatively adsorbing onto the fibers multiple consecutively-applied layers of organized ultra thin and oppositely-charged polyelectrolytes, at least one of said polyelectrolytes being an magnetically active polymer or nanoparticle, and another of said polyelectrolytes having a charge opposite of said magnetically active polymer or nanoparticle, thereby making a modified aqueous pulp of magnetically active multi-layer nanocoated lignocellulose fibers; and (c) draining the water out of the modified aqueous pulp to form magnetically active wood microfibers. Electrically conductive polymers or nanoparticles are materials which exhibit electrical conductivity or semi conductivity properties. Magnetically active polymers or nanoparticles are materials which exhibit magnetic properties. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids.

$8^{th}$ Embodiment

The method of the $7^{th}$ Embodiment, wherein said magnetically active polymer or nanoparticle is chosen from the group consisting of elemental cobalt (Co), cobalt ferrite, cobalt nitride, cobalt oxide, an alloy of cobalt and palladium (Co—Pd), an alloy of cobalt and platinum (Co—Pt), elemental iron (Fe), an alloy of iron and gold (Fe—Au), an alloy of iron and chromium (Fe—Cr), iron nitride (Fe—N), $Fe_3O_4$, an alloy of iron and palladium (Fe—Pd), an alloy of iron and platinum (Fe—Pt), an alloy of iron, zirconium, niobium and boron (Fe—Zr—Nb—B), manganese nitride (Mn—N), an alloy of neodymium, iron and boron (Nd—Fe—B), an alloy of neodymium, iron, boron, niobium and copper (Nd—Fe—B—Nb—Cu), elemental nickel (Ni) and nickel alloys, and said polyelectrolyte having a charge opposite of said magnetically active polymer or nanoparticle is chosen from the group consisting of poly(allylamine hydrochloride) (PAH), branched poly(ethyleneimine) (PEI), poly(diallyldimethylammonium chloride) (PDDA) and poly(styrene sulfonate) (PSS).

$9^{th}$ Embodiment

A method for making magnetically active paper, comprising (a) forming an aqueous pulp of lignocellulose fibers; (b) nanocoating said aqueous pulp of lignocellulose fibers by alternatively adsorbing onto the fibers multiple consecutively-applied layers of organized ultra thin and oppositely-charged polyelectrolytes, at least one of said polyelectrolytes being an magnetically active polymer or nanoparticle, and another of said polyelectrolytes having a charge opposite of said magnetically active polymer or nanoparticle, thereby making a modified aqueous pulp of magnetically active multi-layer nanocoated lignocellulose fibers; (c) draining the water out of the modified aqueous pulp to form sheets of magnetically active multi-layer nanocoated lignocellulose fibers; (d) drying said formed sheets of magnetically active multi-layer nanocoated lignocellulose fibers; and (e) processing the dried nanocoated sheets to make a finished paper having enhanced magnetic properties. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids.

$10^{th}$ Embodiment

The method of the $9^{th}$ Embodiment, wherein said magnetically active polymer or nanoparticle is chosen from the group consisting of elemental cobalt (Co), cobalt ferrite, cobalt nitride, cobalt oxide, an alloy of cobalt and palladium (Co—Pd), an alloy of cobalt and platinum (Co—Pt), elemental iron (Fe), an alloy of iron and gold (Fe—Au), an alloy of iron and chromium (Fe—Cr), iron nitride (Fe—N), $Fe_3O_4$, an alloy of iron and palladium (Fe—Pd), an alloy of iron and platinum (Fe—Pt), an alloy of iron, zirconium, niobium and boron (Fe—Zr—Nb—B), manganese nitride (Mn—N), an alloy of neodymium, iron and boron (Nd—Fe—B), an alloy of neodymium, iron, boron, niobium and copper (Nd—Fe—B—Nb—Cu), elemental nickel (Ni) and nickel alloys, and said polyelectrolyte having a charge opposite of said magnetically active polymer or nanoparticle is chosen from the group consisting of poly(allylamine hydrochloride) (PAH), branched poly(ethyleneimine) (PEI), poly(diallyldimethylammonium chloride) (PDDA) and poly(styrene sulfonate) (PSS).

$11^{th}$ Embodiment

A method for making magnetically active paper, comprising (a) forming an aqueous pulp of lignocellulose fibers; (b) nanocoating a first portion of said aqueous pulp of lignocellulose fibers by alternatively adsorbing onto the fibers multiple consecutively-applied layers of organized ultra thin and oppositely-charged magnetically active polymers or nanoparticles selected from the group consisting of elemental cobalt (Co), cobalt ferrite, cobalt nitride, cobalt oxide, an alloy of cobalt and palladium (Co—Pd), an alloy of cobalt and platinum (Co—Pt), elemental iron (Fe), an alloy of iron and gold (Fe—Au), an alloy of iron and chromium (Fe—Cr), iron nitride (Fe—N), $Fe_3O_4$, an alloy of iron and palladium (Fe—Pd), an alloy of iron and platinum (Fe—Pt), an alloy of iron, zirconium, niobium and boron (Fe—Zr—Nb—B), manganese nitride (Mn—N), an alloy of neodymium, iron and boron (Nd—Fe—B), an alloy of neodymium, iron, boron, niobium and copper (Nd—Fe—B—Nb—Cu), elemental nickel (Ni) and nickel alloys, thereby making a first charged modified aqueous pulp of magnetically active multi-layer nanocoated lignocellulose fibers; (this first portion must be magnetically active) (c) separately nanocoating a second portion of said aqueous pulp of lignocellulose fibers by alternatively adsorbing onto the fibers multiple consecutively-applied layers of organized ultra thin and oppositely-charged polyelectrolytes selected from the group consisting of poly(allylamine hydrochloride) (PAH), branched poly(ethyleneimine) (PEI), poly (diallyldimethylammonium chloride) (PDDA) and poly(styrene sulfonate) (PSS), thereby making a second oppositely-charged modified aqueous pulp of multi-layer nanocoated lignocellulose fibers; (this second portion may be but need not be magnetically active) (d) blending said first charged modified aqueous pulp of magnetically active multi-layer nanocoated lignocellulose fibers with said second oppositely-charged modified aqueous pulp of multi-layer nanocoated lignocellulose fibers to form a complex aggregate pulp of nanocoated fibers; (e) draining the water out of the complex aggregate pulp of nanocoated fibers to form sheets of magnetically active multi-layer nanocoated lignocellulose fibers; (f) drying said formed sheets of magnetically active multi-layer nanocoated lignocellulose fibers; and (g) processing the dried nanocoated sheets to make a finished paper having enhanced magnetic properties. The nanocoating of the first portion of lignocellulose fiber pulp is preferably carried out consecutively through one adsorption step less than the nanocoating of said second portion of lignocellulose fiber pulp. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids. In a variation of the technique illustrated in this $11^{th}$ Embodiment, the second portion of the pulp is nanocoated by alternatively adsorbing onto the fibers multiple consecutively-applied layers of organized ultra thin and oppositely-charged polyelectrolytes chosen from any one or more of the polyelectrolytes used to nanocoat the first portion of the aqueous pulp of lignocellulose fibers.

$12^{th}$ Embodiment

A method for making magnetically active paper, comprising (a) forming an aqueous pulp of lignocellulose fibers; (b) nanocoating a first portion of said aqueous pulp of lignocellulose fibers by alternatively adsorbing onto the fibers multiple consecutively-applied layers of organized ultra thin and oppositely-charged magnetically active polymers or nanoparticles selected from the group consisting of elemental cobalt (Co), cobalt ferrite, cobalt nitride, cobalt oxide, an alloy of cobalt and palladium (Co—Pd), an alloy of cobalt and platinum (Co—Pt), elemental iron (Fe), an alloy of iron and gold (Fe—Au), an alloy of iron and chromium (Fe—Cr), iron nitride (Fe—N), $Fe_3O_4$, an alloy of iron and palladium (Fe—Pd), an alloy of iron and platinum (Fe—Pt), an alloy of iron, zirconium, niobium and boron (Fe—Zr—Nb—B), manganese nitride (Mn—N), an alloy of neodymium, iron and boron (Nd—Fe—B), an alloy of neodymium, iron, boron, niobium and copper (Nd—Fe—B—Nb—Cu), elemental nickel (Ni) and nickel alloys, thereby making a first charged modified aqueous pulp of magnetically active multi-layer nanocoated lignocellulose fibers; (c) separately providing a second portion of said aqueous pulp of lignocellulose fibers; (d) blending said first charged modified aqueous pulp of magnetically active multi-layer nanocoated lignocellulose fibers with said second portion of said aqueous pulp of lignocellulose fibers to form a complex aggregate pulp of nanocoated fibers; (e) draining the water out of the complex aggregate pulp of nanocoated fibers to form sheets of magnetically active multi-layer nanocoated lignocellulose fibers; (f) drying said formed sheets of magnetically active multi-layer nanocoated lignocellulose fibers; and (g) processing the dried nanocoated sheets to make a finished paper having enhanced magnetic properties. (The first portion is nanocoated but the second portion is not).

$13^{th}$ Embodiment

A method for making optically active wood microfibers, comprising (a) forming an aqueous pulp of lignocellulose fibers; (b) nanocoating said aqueous pulp of lignocellulose fibers by alternatively adsorbing onto the fibers multiple consecutively-applied layers of organized ultra thin and oppositely-charged polyelectrolytes, at least one of said polyelectrolytes being an optically ro active polymer or nanoparticle, and another of said polyelectrolytes having a charge opposite of said optically active polymer or nanoparticle, thereby making a modified aqueous pulp of optically active multi-layer nanocoated lignocellulose fibers; and (c) draining the water out of the modified aqueous pulp to form optically active wood microfibers. Optically active polymers or nanoparticles are materials which exhibit change in color when stimulated by electrical, magnetic, thermal, light, chemical, and/or mechanical impulses. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids.

$14^{th}$ Embodiment

The method of the $13^{th}$ Embodiment, wherein said optically active polymer or nanoparticle is chosen from the group consisting of liquid crystals, quantum dots, a leuco dye, a lactone dye, cyanine, napthochinone, elemental manganese (Mn), rhenium (Re), a divalent iron compound (divalent Fe), a divalent palladium compound (divalent Pd), molybdenum or a compound of molybdenum (molybdenum), a divalent copper compound (divalent copper), poly-2-vinyl-pyridine, a solvatochromic dye, ortho-dianisidine, a chromogenic polymer, cobalt chloride, a chromophore, 1,4-bis-α-cyano-4-(12-hydroxydodecyloxy)styryl)-2,5-dimethoxybenzene ($C_{12}$OH-RG), tetrathiafulvalence (TTF), Prussian blue, tetracyanoquinodimethane (TCNQ), elemental gold (Au), elemental silver (Ag) and a thermochromic polymer-organic crystal, and said polyelectrolyte having a charge opposite of said optically active polymer or nanoparticle is chosen from the group consisting of poly(allylamine hydrochloride) (PAH), branched poly(ethyleneimine) (PEI), poly(diallyldimethylammonium chloride) (PDDA) and poly(styrene sulfonate) (PSS).

$15^{th}$ Embodiment

A method for making optically active paper, comprising (a) forming an aqueous pulp of lignocellulose fibers; (b) nanocoating said aqueous pulp of lignocellulose fibers by alternatively adsorbing onto the fibers multiple consecutively-applied layers of organized ultra thin and oppositely-charged polyelectrolytes, at least one of said polyelectrolytes being an optically active polymer or nanoparticle, and another of said polyelectrolytes having a charge opposite of said optically active polymer or nanoparticle, thereby making a modified aqueous pulp of optically active multi-layer nanocoated lignocellulose fibers; (c) draining the water out of the modified aqueous pulp to form sheets of optically active multi-layer nanocoated lignocellulose fibers; (d) drying said formed sheets of optically active multi-layer nanocoated lignocellulose fibers; and (e) processing the dried nanocoated sheets to make a finished paper having enhanced optical properties. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably an aqueous slurry having between about 0.5 and 15% solids.

$16^{th}$ Embodiment

The method of the $15^{th}$ Embodiment, wherein said optically active polymer or nanoparticle is chosen from the group consisting of liquid crystals, quantum dots, a leuco dye, a lactone dye, cyanine, napthochinone, elemental manganese (Mn), rhenium (Re), a divalent iron compound (divalent Fe), a divalent palladium compound (divalent Pd), molybdenum or a compound of molybdenum (molybdenum), a divalent copper compound (divalent copper), poly-2-vinyl-pyridine, a solvatochromic dye, ortho-dianisidine, a chromogenic polymer, cobalt chloride, a chromophore, 1,4-bis-(a-cyano-4-(12-hydroxydodecyloxy)styryl)-2,5-dimethoxybenzene ($C_{12}$OH-RG), tetrathiafulvalence (TTF), Prussian blue, tetracyanoquinodimethane (TCNQ), elemental gold (Au), elemental silver (Ag) and a thermochromic polymer-organic crystal, and said polyelectrolyte having a charge opposite of said optically active polymer or nanoparticle is chosen from the group consisting of poly(allylamine hydrochloride) (PAH), branched poly(ethyleneimine) (PEI), poly(diallyldimethylammonium chloride) (PDDA) and poly(styrene sulfonate) (PSS).

17$^{th}$ Embodiment

A method for making optically active paper, comprising (a) forming an aqueous pulp of lignocellulose fibers; (b) nanocoating a first portion of said aqueous pulp of lignocellulose fibers by alternatively adsorbing onto the fibers multiple consecutively-applied layers of organized ultra thin and oppositely-charged optically active polymers or nanoparticles selected from the group consisting of liquid crystals, quantum dots, a leuco dye, a lactone dye, cyanine, napthochinone, elemental manganese (Mn), rhenium (Re), a divalent iron compound (divalent Fe), a divalent palladium compound (divalent Pd), molybdenum or a compound of molybdenum (molybdenum), a divalent copper compound (divalent copper), poly-2-vinyl-pyridine, a solvatochromic dye, ortho-dianisidine, a chromogenic polymer, cobalt chloride, a chromophore, 1,4-bis-a-cyano-4-(12-hydroxydodecyloxy) styryl)-2,5-dimethoxybenzene ($C_{12}$OH-RG), tetrathiafulvalence (TTF), Prussian blue, tetracyanoquinodimethane (TCNQ), elemental gold (Au), elemental silver (Ag) and a thermochromic polymer-organic crystal, thereby making a first charged modified aqueous pulp of optically active multi-layer nanocoated lignocellulose fibers; (this first portion must be optically active) (c) separately nanocoating a second portion of said aqueous pulp of lignocellulose fibers by alternatively adsorbing onto the fibers multiple consecutively-applied layers of organized ultra thin and oppositely-charged polyelectrolytes selected from the group consisting of poly(allylamine hydrochloride) (PAH), branched poly (ethyleneimine) (PEI), poly(diallyldimethylammonium chloride) (PDDA) and polystyrene sulfonate) (PSS), thereby making a second oppositely-charged modified aqueous pulp of multi-layer nanocoated lignocellulose fibers; (this second portion may be but need not be optically active) (d) blending said first charged modified aqueous pulp of optically active multi-layer nanocoated lignocellulose fibers with said second oppositely-charged modified aqueous pulp of multi-layer nanocoated lignocellulose fibers to form a complex aggregate pulp of nanocoated fibers; (e) draining the water out of the complex aggregate pulp of nanocoated fibers to form sheets of optically active multi-layer nanocoated lignocellulose fibers; (f) drying said formed sheets of optically active multi-layer nanocoated lignocellulose fibers; and (g) processing the dried nanocoated sheets to make a finished paper having enhanced optical properties. The nanocoating of the first portion of lignocellulose fiber pulp is preferably carried out consecutively through one adsorption step less than the nanocoating of said second portion of lignocellulose fiber pulp. The ultra thin and oppositely-charged polyelectrolytes should have a thickness of between about 5 and 200 nanometers. The lignocellulose fibers used to form said aqueous slurry are preferably large softwood fibers having a length of at least about 1 mm in length and a diameter of at least about 15 μm (microns), and the aqueous pulp of lignocellulose fibers is preferably aqueous slurry having between about 0.5 and 15% solids. In a variation of the technique illustrated in this 17$^{th}$ Embodiment, the second portion of the pulp is nanocoated by alternatively adsorbing onto the fibers multiple consecutively-applied layers of organized ultra thin and oppositely-charged polyelectrolytes chosen from any one or more of the polyelectrolytes used to nanocoat the first portion of the aqueous pulp of lignocellulose fibers.

18$^{th}$ Embodiment

A method for making optically active paper, comprising (a) forming an aqueous pulp of lignocellulose fibers; (b) nanocoating a first portion of said aqueous pulp of lignocellulose fibers by alternatively adsorbing onto the fibers multiple consecutively-applied layers of organized ultra thin and oppositely-charged optically active polymers or nanoparticles selected from the group consisting of liquid crystals, quantum dots, a leuco dye, a lactone dye, cyanine, napthochinone, elemental manganese (Mn), rhenium (Re), a divalent iron compound (divalent Fe), a divalent palladium compound (divalent Pd), molybdenum or a compound of molybdenum (molybdenum), a divalent copper compound (divalent copper), poly-2-vinyl-pyridine, a solvatochromic dye, ortho-dianisidine, a chromogenic polymer, cobalt chloride, a chromophore, 1,4-bis-a-cyano-4-(12-hydroxydodecyloxy) styryl)-2,5-dimethoxybenzene ($C_{12}$OH-RG), tetrathiafulvalence (TTF), Prussian blue, tetracyanoquinodimethane (TCNQ), elemental gold (Au), elemental silver (Ag) and a thermochromic polymer-organic crystal, thereby making a first charged modified aqueous pulp of optically active multi-layer nanocoated lignocellulose fibers; (c) separately providing a second portion of said aqueous pulp of lignocellulose fibers; (d) blending said first charged modified aqueous pulp of optically active multi-layer nanocoated lignocellulose fibers with said second portion of said aqueous pulp of lignocellulose fibers to form a complex aggregate pulp of nanocoated fibers; (e) draining the water out of the complex aggregate pulp of nanocoated fibers to form sheets of optically active multi-layer nanocoated lignocellulose fibers; (f) drying said formed sheets of optically active multi-layer nanocoated lignocellulose fibers; and (g) processing the dried nanocoated sheets to make a finished paper having enhanced optical properties. (The first portion is nanocoated but the second portion is not).

While the present invention has been described in terms of particular embodiments and applications, in both summarized and detailed forms, it is not intended that these descriptions in any way limit its scope to any such embodiments and applications, and it will be understood that substitutions, changes and variations in the described embodiments, applications and details of the method illustrated herein and its operation can be made by those skilled in the art without departing from the spirit of this invention.

We claim:

1. A method for making electrically conducting smart paper and/or wood microfibers, comprising:

(a) forming an aqueous pulp of lignocellulose fibers;

(b) nanocoating said aqueous pulp of lignocellulose fibers by alternatively electrostatically adsorbing onto the fibers multiple consecutively-applied layers of organized ultra thin and oppositely-charged polyelectrolytes, at least one of said polyelectrolytes being an electrically conductive polymers, or nanoparticles, or carbon nanotubes, or combination thereof, and another of said polyelectrolytes having a charge opposite of said electrically conductive polymer or nanoparticle, thereby making a modified aqueous pulp of electrically conductive multi-layer nanocoated lignocellulose fibers;

(c) draining the water out of the modified aqueous pulp to form sheets of electrically conducting wood fibers;

(d) drying said formed sheets of electrically conductive multi-layer nanocoated lignocellulose fibers; and (b) processing the dried nanocoated sheets to make a finished paper having enhanced electrical conductivity;

wherein said electrically conductive polymer comprises poly(3,4-ethlene-dioxythiophene)-poly(styrene sulfonate) (PEDOT-PSS) and carbon nanotubes and the finished paper having a greater electrical conductivity than if either PEDOT-PSS and carbon nanotubes were used alone.

2. The method of claim 1, wherein said electrically conductive polymer or nanoparticle is chosen from the group consisting of, polypyrrole (PPY), poly-(3-hexylthiophene (P3HT), polyaniline, polythiophene, polyphenylene, Au, Cu, Ag, Pd, Zr, and Cr, and said polyelectrolyte having a charge opposite of said electrically conductive polymer or nanoparticle is chosen from the group consisting of poly(allylamine hydrochloride) (PAH), branched poly(ethyleneimine) (PEI), poly(diallyldimethylammonium chloride) (PDDA) and poly (styrene sulfonate) (PSS).

3. The method of claim 1, electrostatically adsorbing at least 2 but not more than 20 layers onto the lignocellulose fibers, and wherein said lignocellulose fibers used to form said aqueous pulp are large softwood fibers having a length of at least about 1 mm in length and a diameter of at least about 15 μm, and wherein said ultra thin and oppositely-charged polyelectrolytes have a thickness of between about 2 and 200 nanometers.

4. The method of claim 1, wherein said lignocellulose fibers used to form said aqueous pulp are large softwood fibers having a length of at least about 1 mm in length and a diameter of at least about 15 μm, and wherein said ultra thin and oppositely-charged polyelectrolytes have a thickness of between about 2 and 20 nanometers.

5. The method of claim 1, wherein said aqueous pulp of lignocellulose fibers is an aqueous pulp having between about 0.5 and 15% solids, and wherein said draining of the water out of the modified aqueous pulp to form said sheets of electrically conductive multi-layer nanocoated lignocellulose fibers is carried out on one or more screens.

6. A method for making electrically conducting paper, comprising:

(a) forming an aqueous pulp of lignocellulose fibers;

(b) nanocoating a first portion of said aqueous pulp of lignocellulose fibers by alternatively electrostatically adsorbing onto the fibers multiple consecutively-applied layers of organized ultra thin and oppositely-charged polyelectrolytes, thereby making a first charged modified aqueous pulp of multi-layer nanocoated lignocellulose fibers;

(c) separately nanocoating a second portion of said aqueous pulp of lignocellulose fibers by alternatively electrostatically adsorbing onto the fibers multiple consecutively-applied layers of organized ultra thin and oppositely-charged polyelectrolytes, thereby making a second oppositely-charged modified aqueous pulp of multi-layer nanocoated lignocellulose fibers; and wherein the first portion of charged modified aqueous pulp has an outermost charged layer and the second portion of oppositely-charged modified aqueous pulp has an outermost layer that is oppositely charged from the outermost charged layer of the first portion; and wherein one or more of the layers of polyelectrolytes of at least one of the first or second portions comprise conductive polymers, nanoparticles, carbon nanotubes, or combination thereof;

(d) blending said first charged modified aqueous pulp of multi-layer nanocoated lignocellulose fibers with said second oppositely-charged modified aqueous pulp of multi-layer nanocoated lignocellulose fibers to form a complex aggregate pulp of nanocoated fibers;

(e) draining the water out of the complex aggregate pulp of nanocoated fibers to form sheets of electrically conductive mull-layer nanocoated lignocellulose fibers;

(f) drying said formed sheets of electrically conductive multi-layer nanocoated lignocellulose fibers; and (g) processing the dried nanocoated sheets to make a finished paper having enhanced electrical conductivity.

7. The method of claim 6, wherein said lignocellulose fibers used to form said aqueous pulp are large softwood fibers having a length of at least about 1 mm in length and a diameter of at least about 15 μm, and wherein, said ultra thin and oppositely-charged polyelectrolytes have a thickness of between about 2 and 200 nanometers.

8. The method of claim 6, wherein said nanocoating of said first portion of lignocellulose fiber pulp is carried out consecutively through one adsorption step less than said nanocoating of said second portion of lignocellulose fiber pulp.

9. A method for making electrically conducting paper, comprising:

(a) forming an aqueous pulp of lignocellulose fibers;

(b) nanocoating a first portion of said aqueous pulp of lignocellulose fibers by alternatively electrostatically adsorbing onto the fibers multiple consecutively-applied layers of organized ultra thin and oppositely-charged electrically conductive polymers or nanoparticles or carbon nanotubes or combination thereof, thereby making a first charged modified aqueous pulp of electrically conductive multi-layer nanocoated lignocellulose fibers;

(c) separately providing a second portion of said aqueous pulp of lignocellulose fibers;

(d) blending said first charged modified aqueous pulp of electrically conductive multi-layer nanocoated lignocellulose fibers with said second portion to form a complex aggregate pulp of nanocoated fibers;

(e) draining the water out of the complex aggregate pulp of nanocoated fibers to form sheets of electrically conductive mull-layer nanocoated lignocellulose fibers;

(f) drying said formed sheets of electrically conductive multi-layer nanocoated lignocellulose fibers; and (g) processing the dried nanocoated sheets to make a finished paper having enhanced electrical conductivity.

* * * * *